US008814142B2

(12) United States Patent
Pasto et al.

(10) Patent No.: US 8,814,142 B2
(45) Date of Patent: Aug. 26, 2014

(54) ADJUSTABLE LIFTING AND STABILIZATION RESCUE STRUT SYSTEM WITH IMPROVED JACK AND STRUT ENGAGEMENT MEANS

(75) Inventors: Cris E. Pasto, Spencer, NY (US); George Tillotson, Ithaca, NY (US)

(73) Assignee: Res-Q-Jack, Inc., Elmira, NY (US)

( * ) Notice: Subject to any disclaimer, the term of this patent is extended or adjusted under 35 U.S.C. 154(b) by 0 days.

(21) Appl. No.: 13/271,074

(22) Filed: Oct. 11, 2011

(65) Prior Publication Data

US 2013/0087750 A1 Apr. 11, 2013

Related U.S. Application Data

(63) Continuation-in-part of application No. 12/016,531, filed on Jan. 18, 2008, now Pat. No. 8,033,527.

(51) Int. Cl.
*B66F 3/24* (2006.01)

(52) U.S. Cl.
USPC ..... 254/134; 254/100; 254/133 R; 248/499

(58) Field of Classification Search
CPC ..... B66F 3/10
USPC ..... 254/134, 100, 133 R, 103; 280/763.1, 280/766.1; 269/3, 6, 95, 143, 249, 246; 248/499, 500; 410/145, 149, 151
See application file for complete search history.

(56) References Cited

U.S. PATENT DOCUMENTS

| | | | | | |
|---|---|---|---|---|---|
| 761,413 | A * | 5/1904 | Sohroer | 254/100 |
| 1,406,302 | A * | 2/1922 | Tobias | 254/111 |
| 1,719,084 | A * | 7/1929 | Rodman | 254/100 |
| 2,060,780 | A * | 11/1936 | Woodworth | 254/100 |
| 2,687,268 | A * | 8/1954 | Hawes | 254/101 |
| 3,750,254 | A * | 8/1973 | Krajcik | 254/93 R |
| 4,771,988 | A * | 9/1988 | Scroggins, Sr. | 254/336 |
| 4,899,986 | A * | 2/1990 | Tweedy | 254/8 B |
| 5,054,990 | A * | 10/1991 | Schaeff | 414/694 |
| 5,087,019 | A * | 2/1992 | Peabody et al. | 254/100 |
| 5,810,333 | A * | 9/1998 | Hickerson et al. | 254/93 R |
| 5,897,100 | A * | 4/1999 | Napier et al. | 254/8 B |
| 6,158,705 | A * | 12/2000 | Cudmore et al. | 248/354.1 |
| 6,176,056 | B1 * | 1/2001 | MacKarvich | 52/293.3 |
| 6,334,279 | B1 * | 1/2002 | Oliver et al. | 52/127.2 |
| 6,394,405 | B1 * | 5/2002 | Roxton et al. | 248/354.1 |
| 7,240,885 | B1 * | 7/2007 | Sullivan | 248/354.1 |
| 7,434,785 | B1 * | 10/2008 | McMorrow | 254/291 |
| 7,490,813 | B1 * | 2/2009 | Weddle | 254/93 R |
| 7,600,731 | B2 * | 10/2009 | Pasto | 248/352 |
| 7,628,383 | B2 * | 12/2009 | Cumbers | 254/243 |
| 2002/0050422 | A1 * | 5/2002 | Wymann | 182/82 |
| 2005/0258332 | A1 * | 11/2005 | Pasto | 248/676 |
| 2008/0191183 | A1 * | 8/2008 | Rucks | 254/424 |
| 2013/0087750 | A1 * | 4/2013 | Pasto et al. | 254/134 |

* cited by examiner

*Primary Examiner* — George Nguyen
(74) *Attorney, Agent, or Firm* — Aquilla Patents & Marks PLLC; Thomas T. Aquilla

(57) ABSTRACT

A lifting strut and stabilization system includes a lower outer tubular member in slidable engagement with an upper extendable inner tubular member, a mechanism for receiving and supporting a jack on the outer tubular member, a pin for optionally restraining the upper tubular member from further engagement into the lower tubular member, while allowing unrestrained extension of the upper tubular member from within the lower tubular member, and a removably attached jack having a bracket at its upper end incorporating a saddle or half-hole for engaging a strut lift pin located in a corresponding saddle, half-hole or flat bearing surface located on the upper end of the lower tubular member, the lift pin extending through the saddle holes in the upper tubular member, such that upon actuation of the jack, the upper jack bracket engages the lift pin and extends the upper tubular member from within the lower tubular member.

40 Claims, 36 Drawing Sheets

ADJUSTABLE LIFTING AND STABILIZATION RESCUE STRUT SYSTEM WITH IMPROVED JACK AND STRUT ENGAGEMENT MEANS

REFERENCE TO RELATED APPLICATIONS

This is a continuation-in-part patent application of co-pending application Ser. No. 12/016,531, filed Jan. 18, 2008, entitled "Adjustable Lifting and Stabilization Rescue Strut System". The complete disclosure of the aforementioned application is hereby incorporated herein by reference in its entirety.

BACKGROUND OF THE INVENTION

1. Field of the Invention

The invention pertains to the field of portable supports or bracing systems. More particularly, the invention pertains to an adjustable, telescopic lifting strut and stabilization system, suitable for use in stabilizing a vehicle at the scene of an accident or similar emergency situation.

2. Description of Related Art

When an automobile, truck or other motor vehicle is involved in an accident, there are occasions when the vehicle comes to rest on its side or its roof, for example, or against an object, such as a tree, utility pole or another vehicle. In such situations, the vehicle must be stabilized to allow rescue personnel to remove the driver and passengers. Moreover, in order to prevent further injury to the occupants of the vehicle or rescue personnel, or further damage to the vehicle itself, the vehicle usually must be stabilized in the position at which it has come to rest. A roof-resting motor vehicle, for example, can be an especially difficult situation for rescue teams, particularly in terms of vehicle stabilization. Vehicle stabilization is thus the first critical step in securing an accident scene, and quick and simple solutions are desired, as time spent on vehicle stabilization is time not spent on victim extrication and patient care.

Because of the wide variety of positions to which a vehicle involved in an accident may come to rest, it is necessary for rescue teams to have available a stabilization support or bracing system that is adjustable to various positions and heights. In addition, stabilization is a task that typically is performed by rescue personnel, as they prepare to remove the occupants from the vehicle. Therefore, the stabilization support or bracing system should be capable of being assembled quickly and easily. It also is necessary for the stabilization system to be transported easily, so that rescue personnel can quickly bring the stabilization support from an emergency vehicle to the vehicle to be supported. Hence, the weight of the stabilization support or bracing apparatus should be minimized and the components should be compact, since space on rescue vehicles generally is quite limited, due to the large variety of equipment required to handle various rescue operations.

Furthermore, there are instances in which a significant portion of the weight of a vehicle must be supported by the stabilization support or bracing apparatus, necessitating an apparatus or system that can support a large amount of weight (i.e., the weight of a vehicle). Further, since a stabilization support typically is used repeatedly throughout its lifetime, durability also is preferred. It is therefore desirable to develop a vehicle stabilization support that is strong, durable, adjustable and reusable, yet economical and easy to transport and set up, and highly versatile. For example, the ideal stabilization system should be adaptable for use in vehicle rescue, collapse rescue, confined space rescue, trench rescue, as a ram, shore, strut, etc., for stabilizing, lifting, shoring, pushing, ramming, etc.

Stabilization supports of the prior art include wood, such as four-by-four (4×4) beams that are wedged in between a stable surface, such as the ground, and the area of the vehicle to be supported. These primitive shoring supports lack adjustability and are not durable, often being discarded after one use, and suffer from numerous other practical limitations. For example, they are relatively heavy and they cannot be disassembled, collapsed or folded for storage, and thus take up an inordinate amount space in the rescue vehicles, where space is at a premium.

Other stabilization supports of the prior art include various metal strut members, some of which rely on jacks or pneumatic pressure to position and/or stabilize the brace against the vehicle. For example, U.S. Pat. No. 6,017,170, assigned to American Rescue Technologies, Inc., discloses an "Adjustable Self Locking Shoring Strut", consisting of a pneumatic/hydraulic shoring strut for bracing walls in various situations. In its preferred embodiment, this strut contains an internal biasing member that urges contraction, when pneumatic pressure is released. More particularly, the pneumatic/hydraulic shoring strut is composed of an inner and outer cylinder, which form an annular recess therebetween. The cylinders are mounted in first and second caps and an annular drive piston is positioned within the annular recess, creating first and second chambers. A port for injecting air into the first chamber is mounted on the outer cylinder and hydraulic fluid is sealed in the second chamber. A channel is provided in one of the caps, providing fluid communication between the second chamber and an interior cavity located within the inner cylinder, where a working piston is reciprocatingly mounted. The channel has a unidirectional flow control valve and a releasable flow restriction control mounted therein, thereby facilitating the self-locking feature of the strut.

U.S. Pat. No. 6,158,705, assigned to Airshore International Direct Equipment West Ltd., discloses a "Vehicle Stabilization and Support Tool", consisting of a tool for stabilizing and supporting a vehicle by forming a rigid member between a bearing surface and the vehicle, including at least one member having a cylinder and a movable piston that protrudes axially from the cylinder at a cylinder end. The cylinder end is formed with a pair of inclined circumferential surfaces. A collar extends axially from the cylinder and slidably receives the protruding piston. The collar is formed with a pair of internal annular step surfaces corresponding to the cylinder end surfaces. The collar step surfaces and the cylinder circumferential surfaces are engagable to permit rotation and simultaneous axial movement of the collar with respect to the cylinder. A pin is selectively positionable at one of a plurality of holes along the piston for engagement with the collar to prevent movement of the piston with respect to the collar. A locking system is provided for releasably securing the collar against rotation relative to the cylinder. In use, the piston is extended from the cylinder and the pin is inserted through one of the holes along the piston to define an initial extended position. The collar is then rotated to move axially into engagement with the pin and locked in place with respect to the cylinder to define a final fixed extended position of the tool.

U.S. Pat. No. 6,776,383 to Lanka discloses a "Vehicle Bracing Apparatus and Method for Use". The brace includes a main tube including a first end and a second end and defining at least one first set of orifices. An extension tube is disposed in the main tube from the first end and defines at least one second set of orifices. The position of the extension tube is set by selectively aligning at least one set of orifices from the first set and at least one set of orifices from the second set and inserting a fastener through the aligned orifices. A vehicle anchor is removably connected to the extension tube and a footer is removably connected to the second end of the main tube.

U.S. Pat. No. 5,810,333, assigned to Curtiss Wright Flight Systems, Inc., discloses a ram device comprising a spreading tool that includes a hollow tube, a first ram member, and a second ram member. The hollow tube has a tubular wall with an axial throughbore and at least one opening extending through the tubular wall. The ram members are slidingly disposed within the throughbore, and at least one ram member is capable of extending beyond the outer edge of the hollow tube. The tool can be adapted for use with a force multiplying device which transmits an output force through a relative displacement between at least two spreadable tips. The first and second ram members are capable of being spaced apart by the force multiplying device such that the tool is capable of extending the expandable distance of the jaws and increasing the distance over which the output force is transmitted.

U.S. Publication No. 2005-0258332A1, assigned to Res-Q-Jack, Inc., discloses a folding telescopic buttress stand that includes a first two-piece telescopic section having an outer tubular member and an inner tubular member in slidable engagement, the outer tubular member being pivotally attached at its lower end to a base plate, and the inner tubular member having attached at its upper end a second two-piece telescopic section having an outer tubular member and an inner tubular member in slidable engagement. One embodiment includes an end fitting or adapter for engagement with a vehicle or other object affixed to the upper end of the inner tubular member. Another embodiment includes a third two-piece telescopic section having an outer tubular member and an inner tubular member in slidable engagement affixed to the upper end of the second two-piece telescopic section.

A wide variety of stabilization struts are known in the art, such as, for example, those manufactured and sold under the names Rescue 42, Inc. (a.k.a. rescue42) Composite Telecribbing Rescue Struts, Hurst Airshore, Paratech Rescue Support Systems (a.k.a. RescueStrut), Genesis Rescue Systems' Kodiak vehicle stabilization system, Junkyard Dog Industries Nightmare and G-Force rescue struts, Prospan Manufacturing Company, ARS, StabFast, Keeble Rescue Systems Marquee strut, and Powerhawk Power Pusher Rams.

Although there are many known devices that are intended to aid in stabilizing a vehicle at the scene of an accident, the prior art devices suffer from a number of limitations. For example, one problem with the prior art devices is that the devices are heavy, cumbersome and difficult to transport and set up. Moreover, lifting struts known in the prior art require pin removal and reinsertion to attach a jack. Furthermore, prior art add-on jacks, such as the Rescue 42 jack, are configured to extend from the strut base up to the upper extension tube, which makes for heavy assembly. Thus, there remains a need in the art for an adjustable lifting strut that is lightweight but strong, durable, adjustable and reusable, yet economical and easy to transport and set up.

SUMMARY OF THE INVENTION

Provided herein is a portable, adjustable, telescopic lifting strut and stabilization system, suitable for use in stabilizing a vehicle at the scene of an accident or similar emergency situation. Briefly stated, an improved telescopic lifting strut and stabilization system includes a lower outer tubular member in slidable engagement with an upper extendable inner tubular member, with a pocket or catch for receiving and supporting a jack on the outer tubular member, and a pin for restraining the upper extendible tubular member from further engagement into the lower tubular member, while allowing unrestrained extension of the upper tubular member from within the lower tubular member, and a removably attachable jack having a bracket at its upper end incorporating a saddle or half-hole for engaging a strut lift pin located in a corresponding saddle, half-hole or flat bearing surface located on the upper end of the lower tubular member, the lift pin extending through the saddle holes in the upper tubular member, such that upon actuation of the jack, its upper bracket engages the lift pin and extends the upper telescopic tubular member from within the lower tubular member.

According to a preferred aspect of the present invention, herein is disclosed an improved adjustable, telescopic lifting strut and stabilization system that includes a removably attachable jack. An advantage of the present invention is that it provides quick, simple means for stabilizing a vehicle, providing essentially infinite adjustability and a configuration suitable for practically any contemplated application at the scene of an accident.

According to another preferred aspect of the present invention, herein is disclosed an improved adjustable, telescopic lifting strut and stabilization system that includes an attached ratchet strap for securing the strut to another object.

According to yet another preferred aspect of the present invention, herein is disclosed an alternative embodiment including staggered saddle holes on different faces of an extendible tubular member to allow for fine adjustment of the length of the lifting strut.

These and other features and advantages will become readily apparent from the following Detailed Description, which should be read in conjunction with the accompanying drawings.

BRIEF DESCRIPTION OF THE DRAWING

The drawing figures are not necessarily to scale, with the emphasis instead placed upon the principles of the present invention. Additionally, each of the embodiments depicted are but one of a number of arrangements possible utilizing the fundamental concepts of the present invention. The drawings are briefly described as follows.

DETAILED DESCRIPTION OF THE INVENTION

The following description relates to certain preferred embodiments of a portable, adjustable, telescopic lifting strut and stabilization system. Numerous variations and modifications, other than those specifically indicated, will be readily apparent to those of sufficient skill in the art. In addition, certain terms are used throughout the discussion in order to provide a convenient frame of reference with regard to the accompanying drawings, such as "front", "back", "inner", "outer", "upper", "lower", and the like. Such terms are not intended to be specifically limiting of the invention, except where so indicated in the claims.

The invention provides a portable, adjustable, telescopic lifting strut and stabilization system, suitable for use in stabilizing a vehicle at the scene of an accident or similar emergency situation. The invention provides an improved strut for rescue applications having numerous features that extend its utility, including, for example, an attached ratchet strap, a removably attachable lift jack, and other useful features in a similar vein. The invention further provides a variety of improvements, including attachments and accessories, which further enhance the features and improve the utility of the disclosed embodiments.

Figure 1:
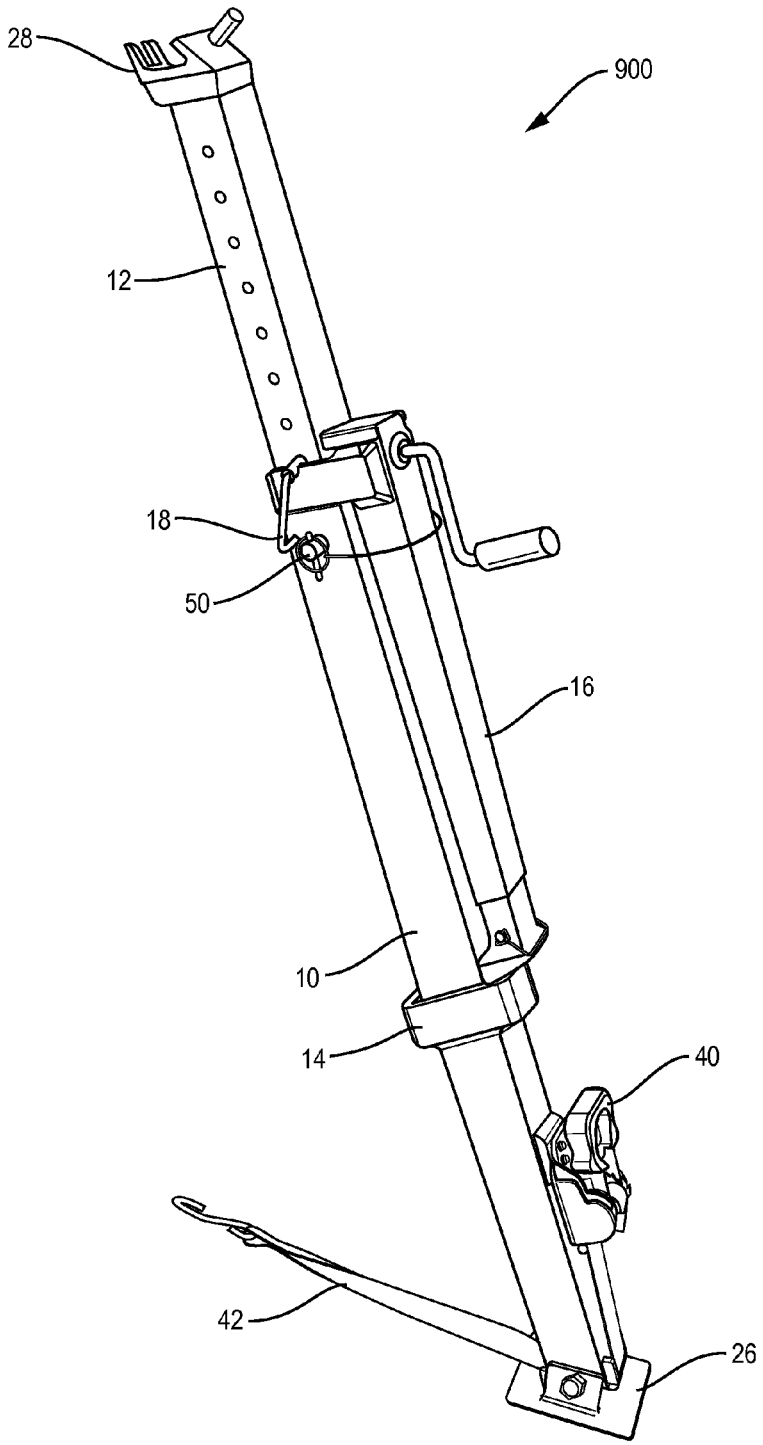
FIG. 1 shows a portable, adjustable, telescopic lifting strut and stabilization system, according to an embodiment of the invention.
Figure 2:
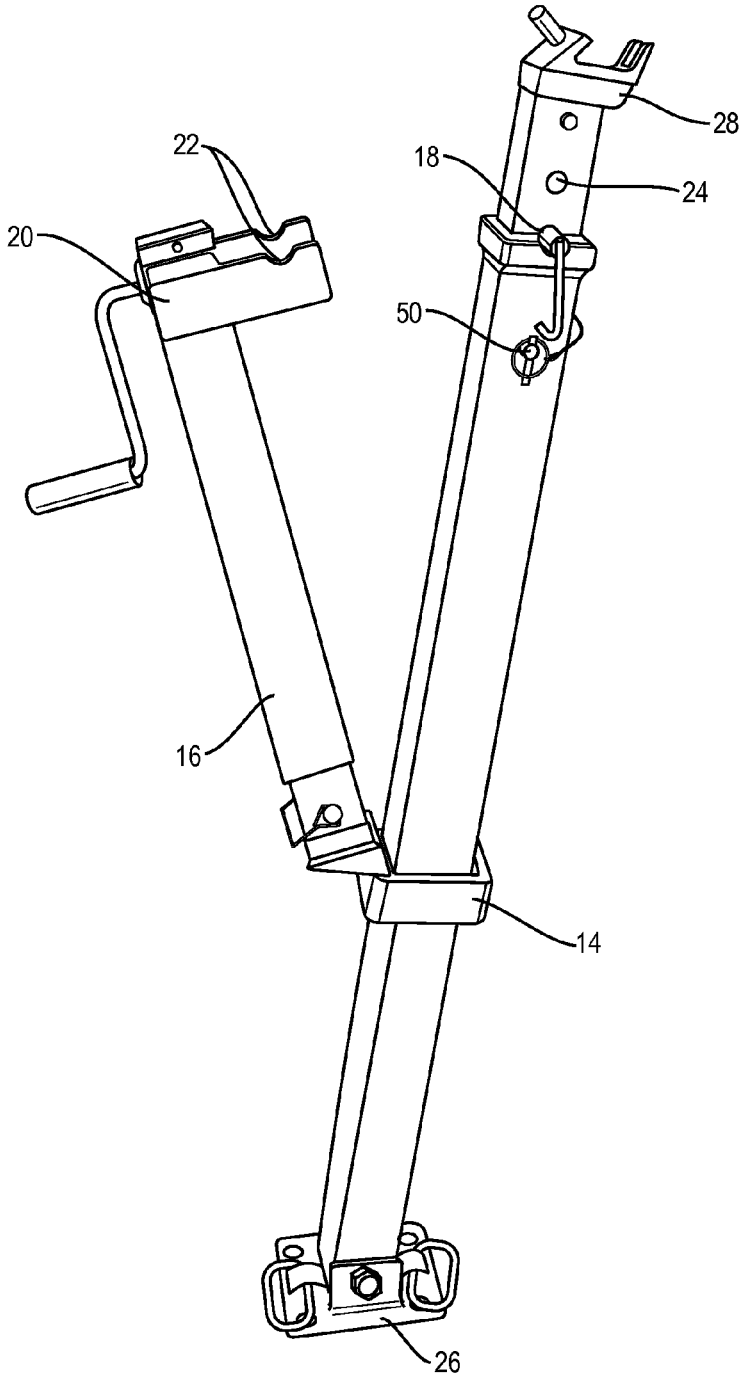
FIG. 2 shows the strut stabilization system of FIG. 1 with a removably attached hand jack being engaged with the strut, according to an embodiment of the invention.

Referring generally to FIGS. 1 and 2, an embodiment of a telescopic lifting strut and stabilization system 900 is shown, including a lower outer tubular member 10 in slidable engagement with an upper extendable inner tubular member 12. The lower outer tubular member 10 is pivotally attached at its lower end to a base plate 26, while the upper extendible tubular member 12 has an end fitting 28 affixed at its upper end for engaging and supporting the object to be stabilized (e.g., an over-turned vehicle). The base plate 26 and end fitting 28 preferably are removable. Note that in the figures a two-piece telescopic strut is shown, which generally is preferable, due to its simplicity of operation. However, additional telescopic sections are deemed to be within the scope of the invention. The inner and outer tubes also optionally include stop collars (not shown), or other means for preventing unsafe over-extension of the sections. Optionally a carrying handle (not shown) is attached to one of the tubular members. In the embodiment shown in the figures, the tubular members comprise an aluminum alloy, however, numerous other materials are acceptable, such as, for example, steel and steel alloys, titanium and titanium alloys, chrome vanadium, other metals and their alloys, as well as non-metal and/or composite materials, including carbon fiber, for example.

Figure 3:
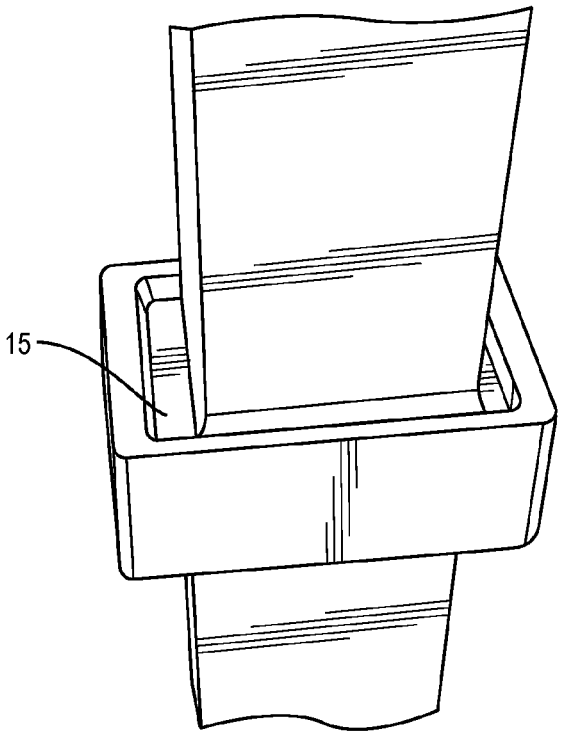
FIG. 3 shows a detail view of the jack-supporting pocket of the strut stabilization system of FIG. 1, according to an embodiment of the invention.
Figure 4:
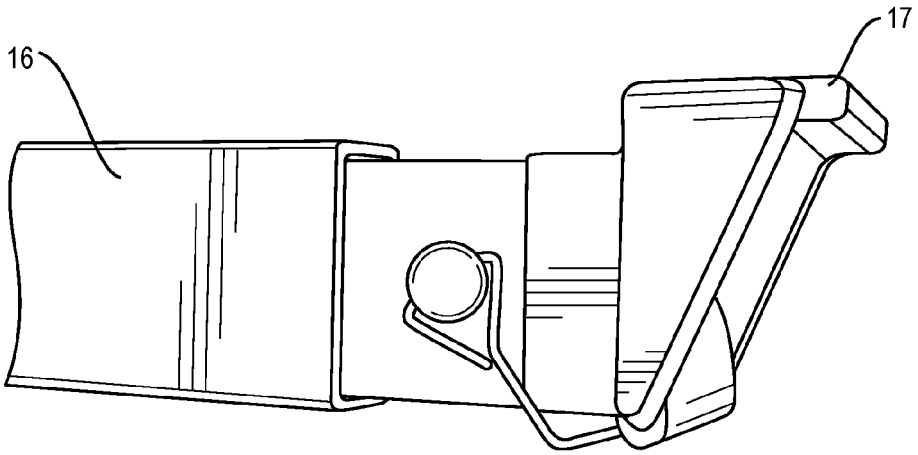
FIG. 4 shows a detail view of the lower jack support bracket of the jack shown in FIGS. 1 and 2, according to an embodiment of the invention.
Figure 5:
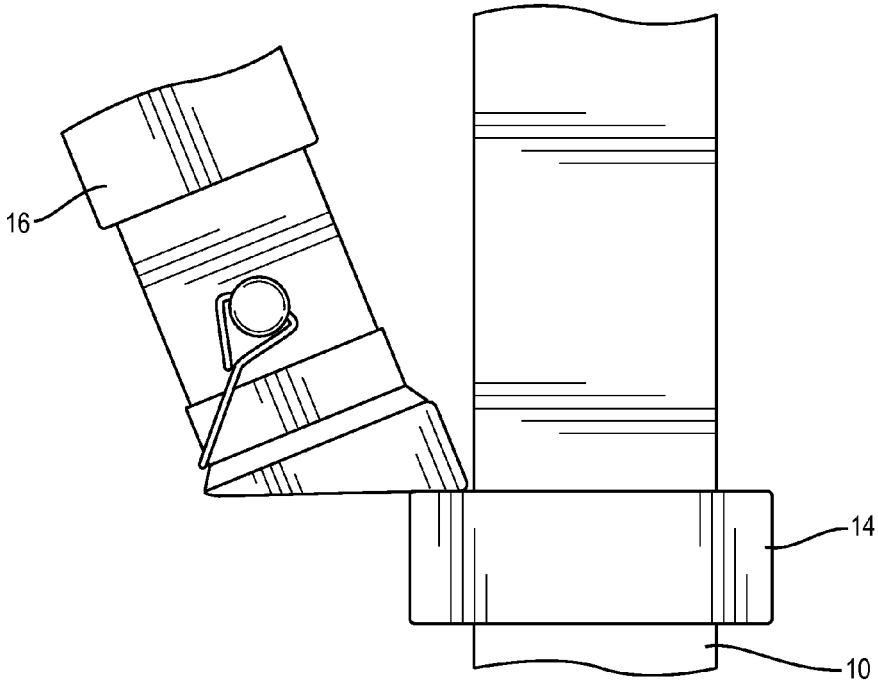
FIG. 5 shows a detail view of the lower jack support bracket of a jack being engaged with the jack-supporting pocket of the strut stabilization system of FIG. 1, according to an embodiment of the invention.
Figure 6:
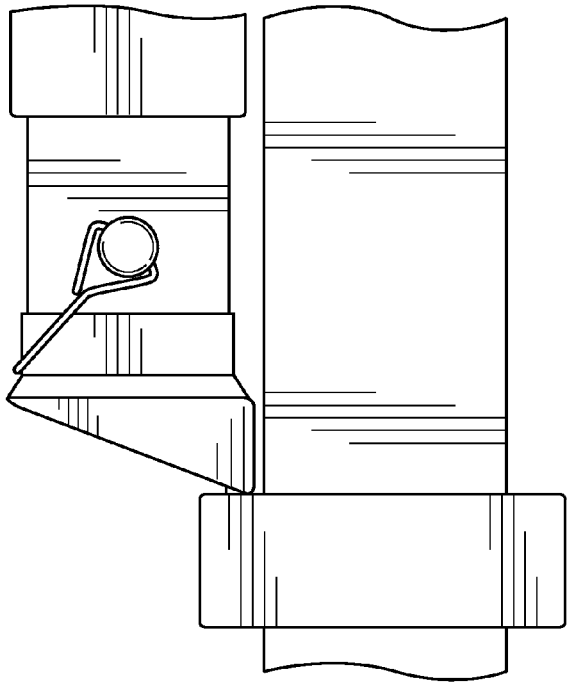
FIG. 6 shows a detail view of the jack fully engaged with the jack-supporting pocket of the strut stabilization system of FIG. 1, according to an embodiment of the invention.
Figure 7:
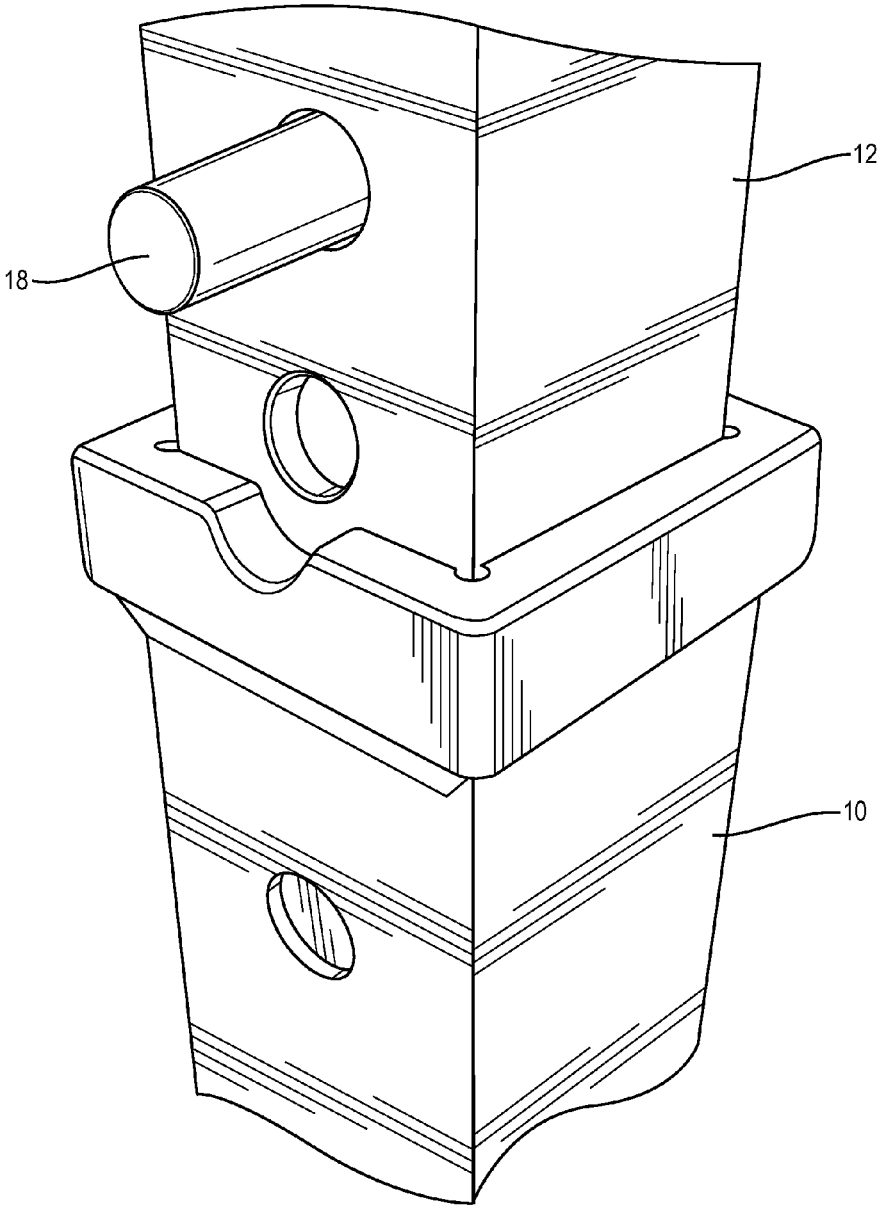
FIG. 7 shows a detail view of the extendible inner tubular member in sliding engagement with the outer lower tubular member of the strut stabilization system of FIG. 1, and an engaged lift pin for restraining further engagement of the upper extendible tubular member down into the lower tubular member, according to an embodiment of the invention.
Figure 8:
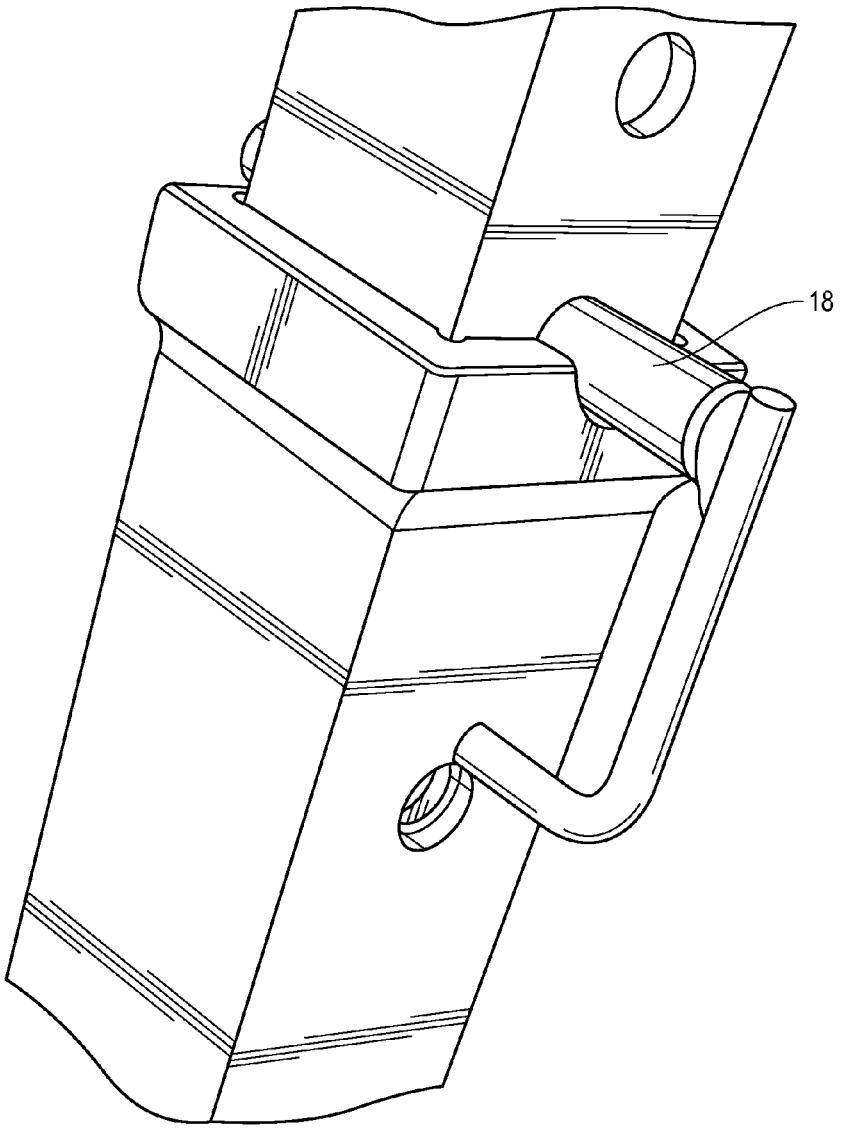
FIG. 8 shows a detail view of the strut stabilization system of FIG. 7, with the lift pin in full engagement with the saddle notches at the upper end of the lower outer tubular member, thereby restraining further engagement of the upper extendible tubular member down into the lower tubular member, according to an embodiment of the invention.
Figure 9:
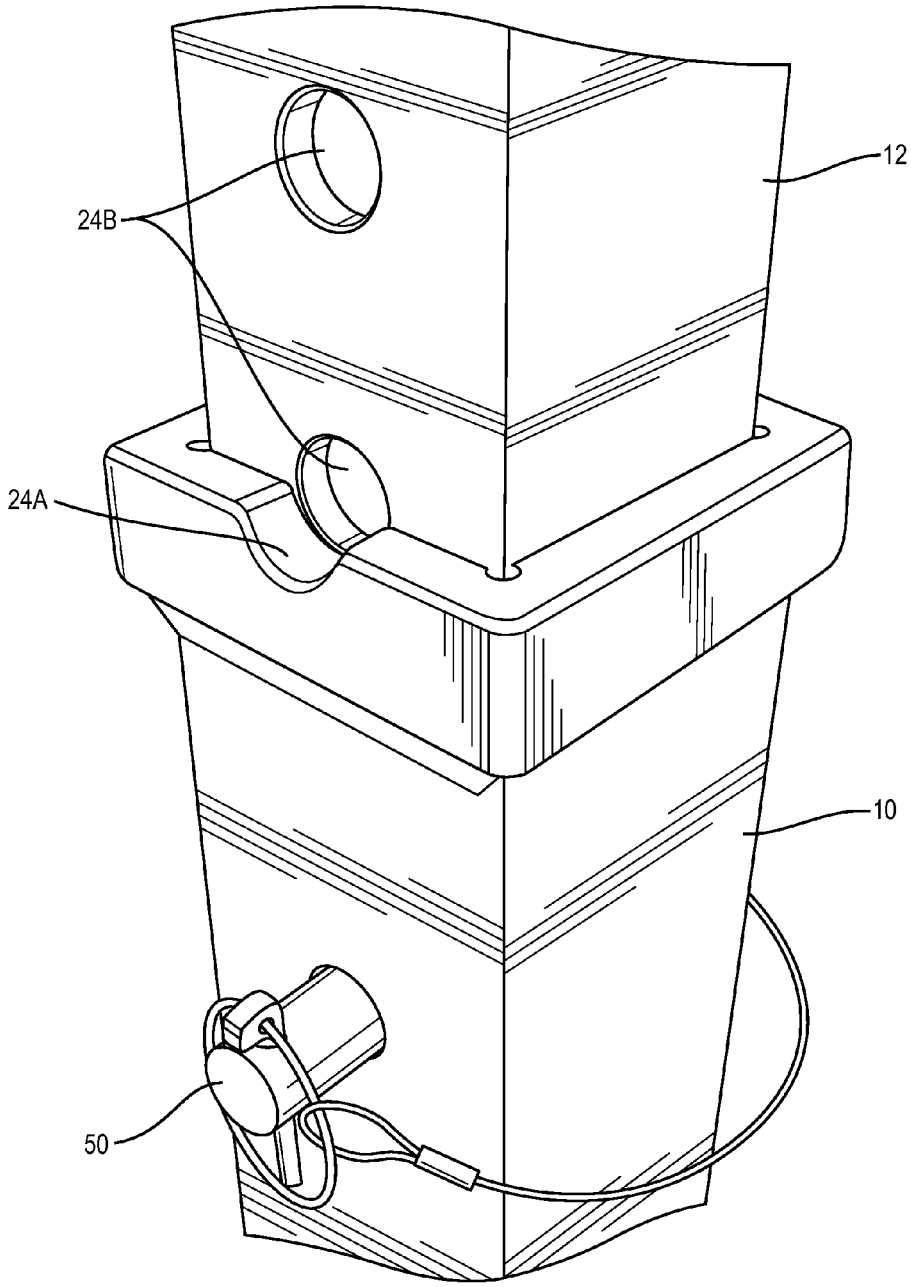
FIG. 9 shows a detail view of the tubular members of FIGS. 7 and 8 locked together with a shoring pin and keeper, thereby preventing the extendible inner tubular member from further engagement into the lower outer tubular member, and also preventing extension of the upper inner tubular member from within the lower outer tubular member, according to an embodiment of the invention.
Figure 10:
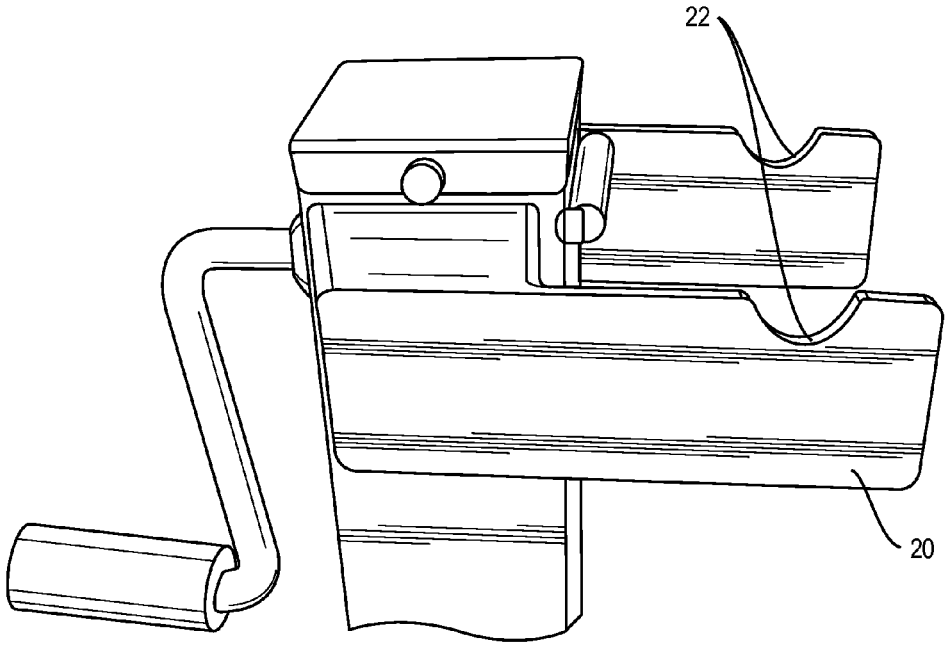
FIG. 10 shows a detail view of the upper end of a hand jack and its lifting bracket and saddle notches for engagement with a strut lift pin, according to an embodiment of the invention.
Figure 11:
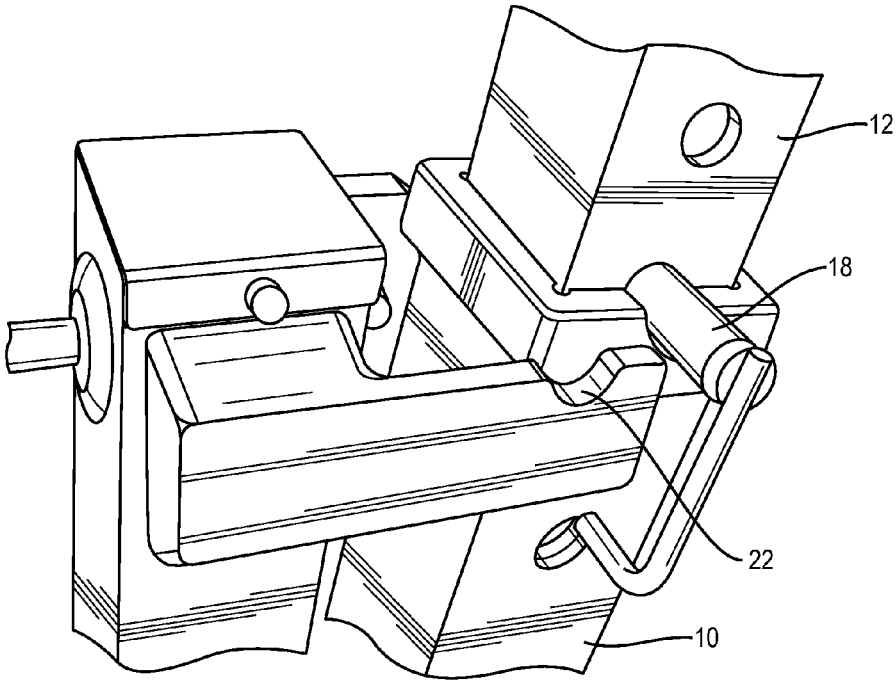
FIG. 11 shows a detail view of the upper end of the hand jack of FIG. 10 and its lifting bracket and saddle notches being engaged with a strut lift pin for lifting the extendible upper tubing member of the lifting strut system, according to an embodiment of the invention.
Figure 12:
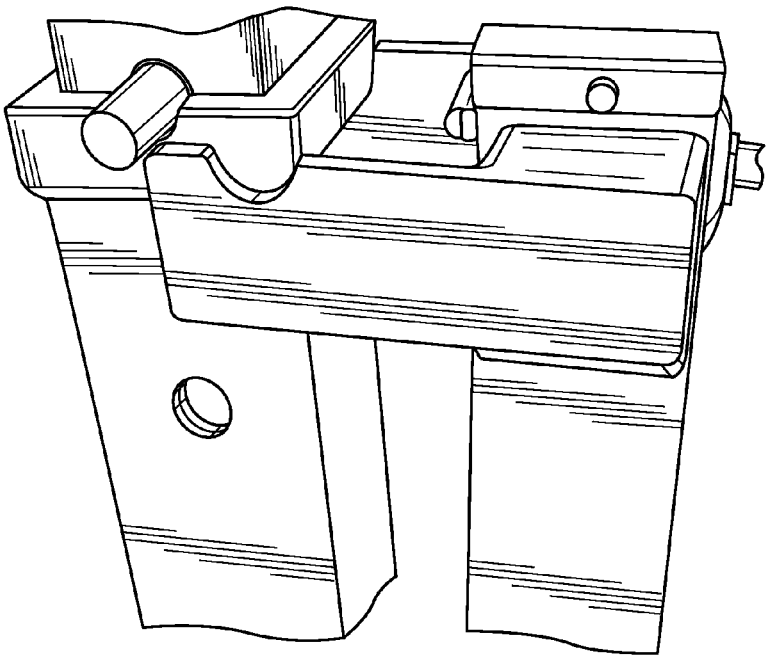
FIG. 12 shows an alternative detail view of the upper end of the hand jack of FIG. 10 and its lifting bracket and saddle notches being engaged with a strut lift pin for lifting the extendible upper tubing member of the lifting strut system, according to an embodiment of the invention.
Figure 13:
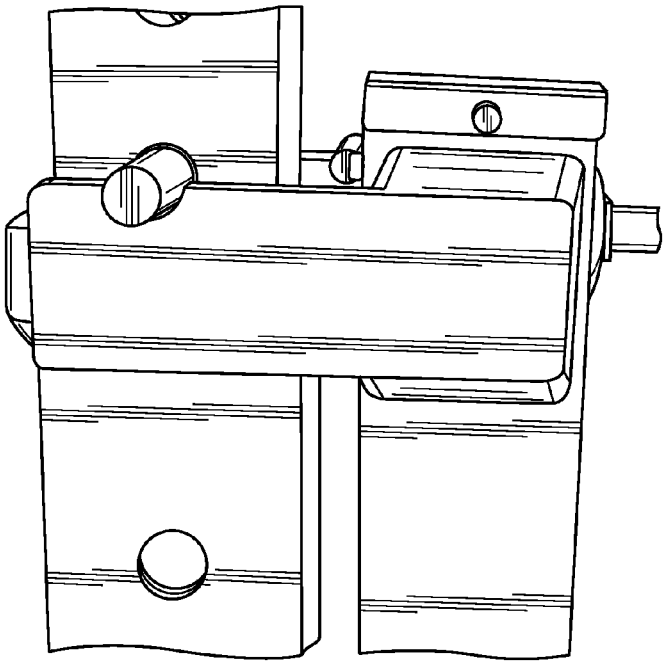
FIG. 13 shows a detail view of the upper end of the hand jack of FIG. 10 and its lifting bracket and saddle notches fully engaged with the strut lift pin for lifting the extendible upper tubing member of the lifting strut system, according to an embodiment of the invention.
Figure 14:
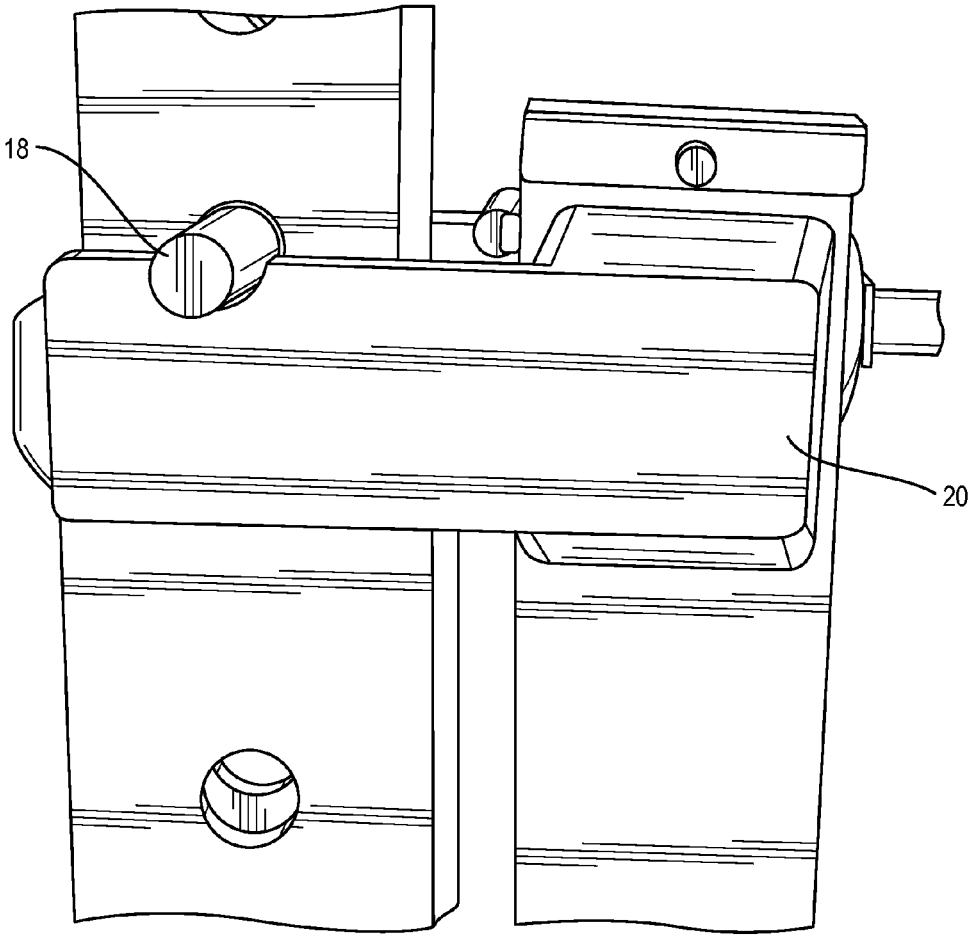
FIG. 14 shows a detail view of the hand jack of FIG. 10 and its lifting bracket and saddle notches fully engaged with the strut lift pin and lifting the extendible upper tubing member of the lifting strut system, according to an embodiment of the invention.
Figure 15:
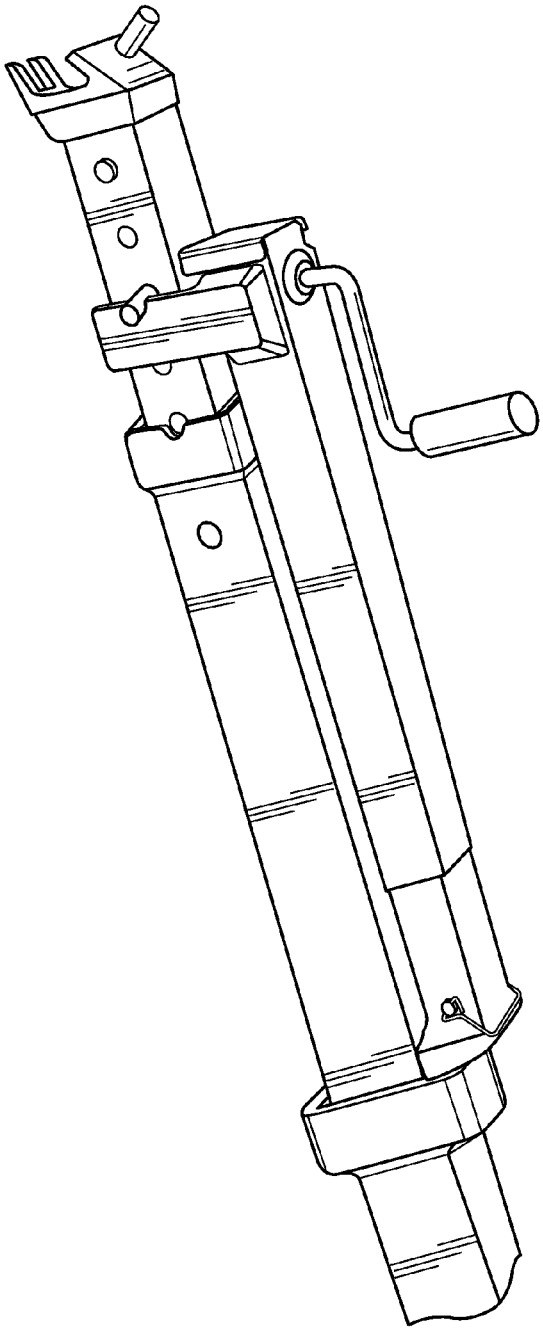
FIG. 15 shows a detail view of the lifting strut and stabilization system of FIG. 1 with a fully attached hand jack engaged with the strut lift pin and lifting the upper extendible tubular member from within the lower outer tubular member, according to an embodiment of the invention.
Figure 16:
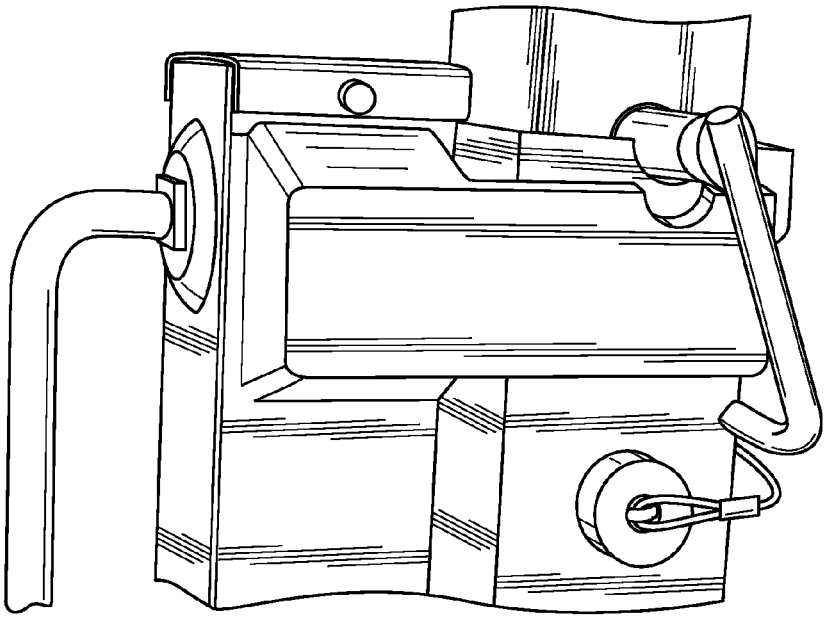
FIG. 16 shows a detail view of the lifting strut and stabilization system of FIG. 1 locked in position with a shoring pin, according to an embodiment of the invention.
Figure 17:
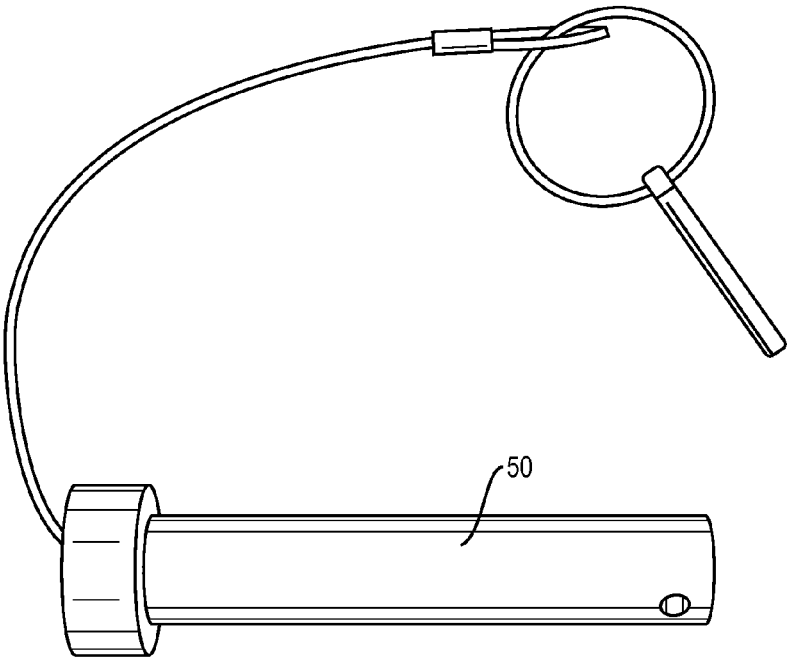
FIG. 17 shows a detail view of the shoring pin, according to an embodiment of the invention.

FIG. 3 shows a detail view of the preferred jack-supporting means 14 of the strut stabilization system. A jack-receiving and supporting means 14, comprising a pocket 15 or catch, is fixed on the outer tubular member 10 for supporting a lift jack 16, and a strut lift pin 18 restrains the upper tubular member 12 from further engagement into the lower tubular member 10, while allowing unrestrained extension of the upper tubular member from within the lower tubular member. The jack-receiving and supporting means can be located on a single face of the tubular member, or for greater versatility, on multiple faces (or all four). Referring now to FIGS. 3-6, the removably attachable jack 16 includes a support lip 17 that inserts into the jack-receiving and supporting pocket 14 affixed to the strut outer tube 10 without pinning.

Referring now to FIGS. 7 and 10-14, the upper end of the jack 16 includes a jack lift bracket 20, which incorporates a pair of notches, recesses, saddle or half-holes 22 for aligning with and engaging the strut lift pin 18 located in a corresponding similarly-shaped saddle, half-hole or flat bearing surface 24A located on the upper end of the lower tubular member 10, and engages the corresponding holes 24B in the upper tubular member 12. The lift pin 18 extends through the holes 24B in the extendible upper tubular member 12, such that upon actuation of the jack 16, the upper jack lift bracket 20 engages the lift pin 18 and extends the upper extendible tubular member 12 from within the lower tubular member 10. The lift pin 18 bearing on the paired recesses, saddle holes, half-holes or flat bearing surface 24A located on the upper end of the lower tubular member 10 restricts the upper inner tube from further engagement into the lower outer tube, while still allowing for free extension of the inner tube relative to the outer tube. The shape of the recesses or saddle holes preferably provides for a maximum bearing surface area on the tube wall and lift pin.

Figure 18:
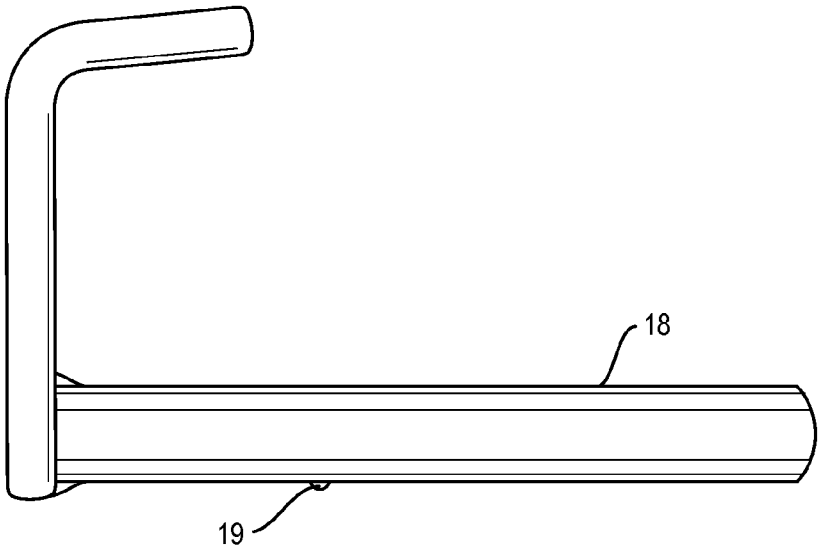
FIG. 18 shows a detail view of the lifting pin, according to an embodiment of the invention.

The lifting means of the strut requires a lift pin that extends a minimum distance out each side of the strut lower outer tube 10 to allow for proper engagement with the lift jack 16. Additionally, the lift pin 18 preferably includes means for preventing unintentional pull-out. It is also preferable for the lift pin to have an ergonomic handle for ease of insertion and removal. Referring now to FIG. 18, to fulfill the above requirements, the lift pin 18 preferably includes a spring loaded detent ball 19 and a handle that is attached to the end of the pin perpendicular to the pin axis. At an end of the handle opposite the end affixed to the pin shaft, the handle preferably has a return leg that runs parallel to the pin shaft. The return leg is of a length which positions the strut tube wall between the end of the return leg and the detent ball. To insert the lift pin 18, push the pin such that the detent ball 19 compresses into the lift pin shaft, thereby allowing the pin to pass through the holes in the tubing. The pin handle should be aligned in a manner such that the end of the return leg will strike the side of strut. The position of the lift pin should thus allow for the add-on jack to properly engage the lift pin.

Some prior art struts are known to have a strap that runs up to the upper end fitting that engages an object at the top of the strut (e.g., vehicle). These straps then run down to a second engagement point with the same object, and then the strap returns to the base of the strut. This assembly is time consuming, requires a greater strap length, and is particularly unfriendly to lifting struts. One type of strut known in the prior art has a base with an off-set pre-attached strap. The strap ratchet mechanism is low on the base pad, where debris is likely to interfere and a user must reach low to operate the ratchet. The strap is off-set to one side of the base, which can cause twisting of the base, unless the strap returns to the opposite side of the base. A strap commonly is attached to the front of a strut base, since this structure is typical of virtually all struts in the field.

Figure 19:
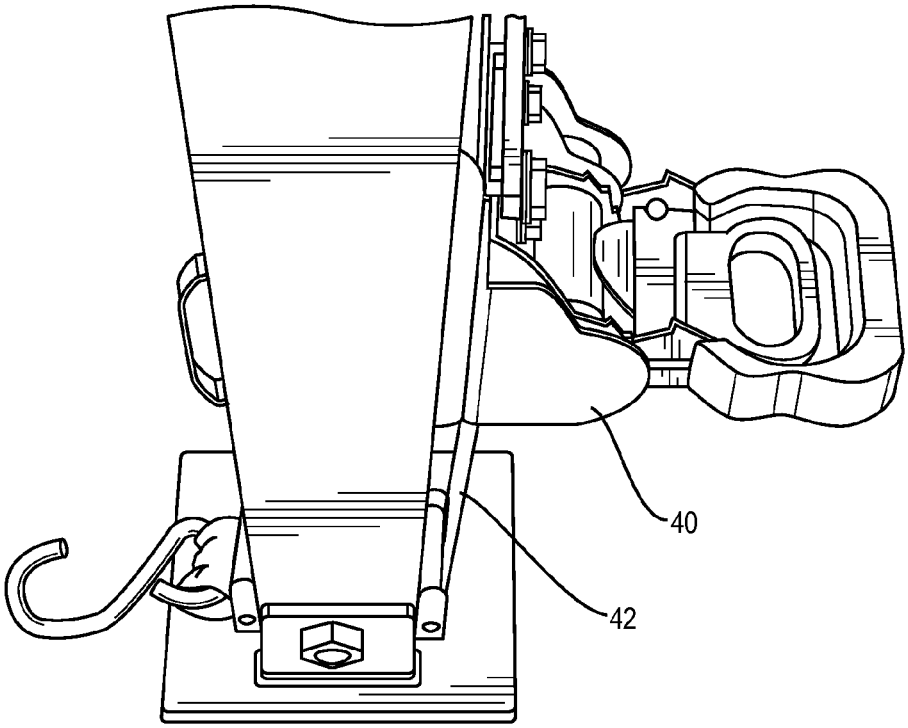
FIG. 19 shows an alternative embodiment according to the invention, with an attached ratchet strap.
Figure 20:
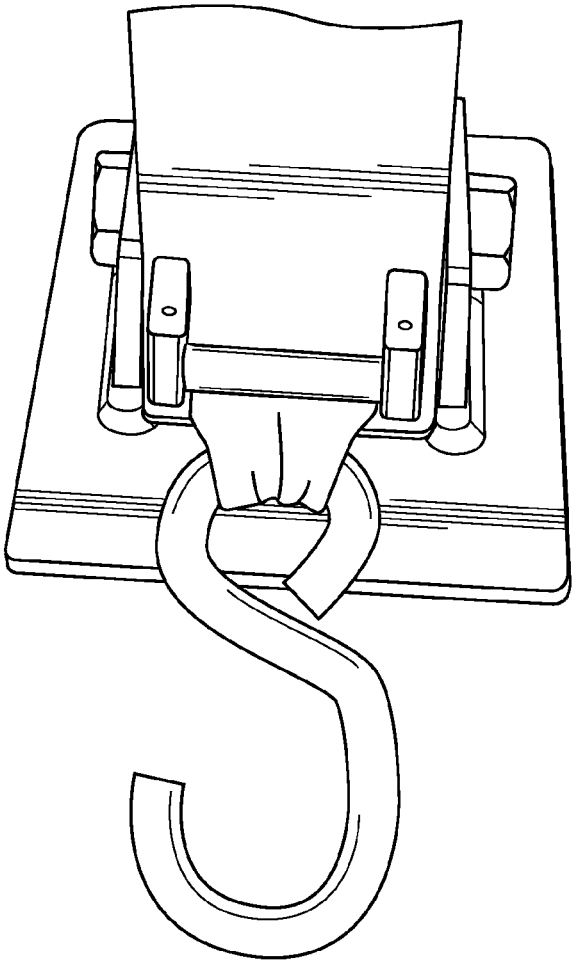
FIG. 20 shows a detail view of the embodiment of FIG. 19.
Figure 21:
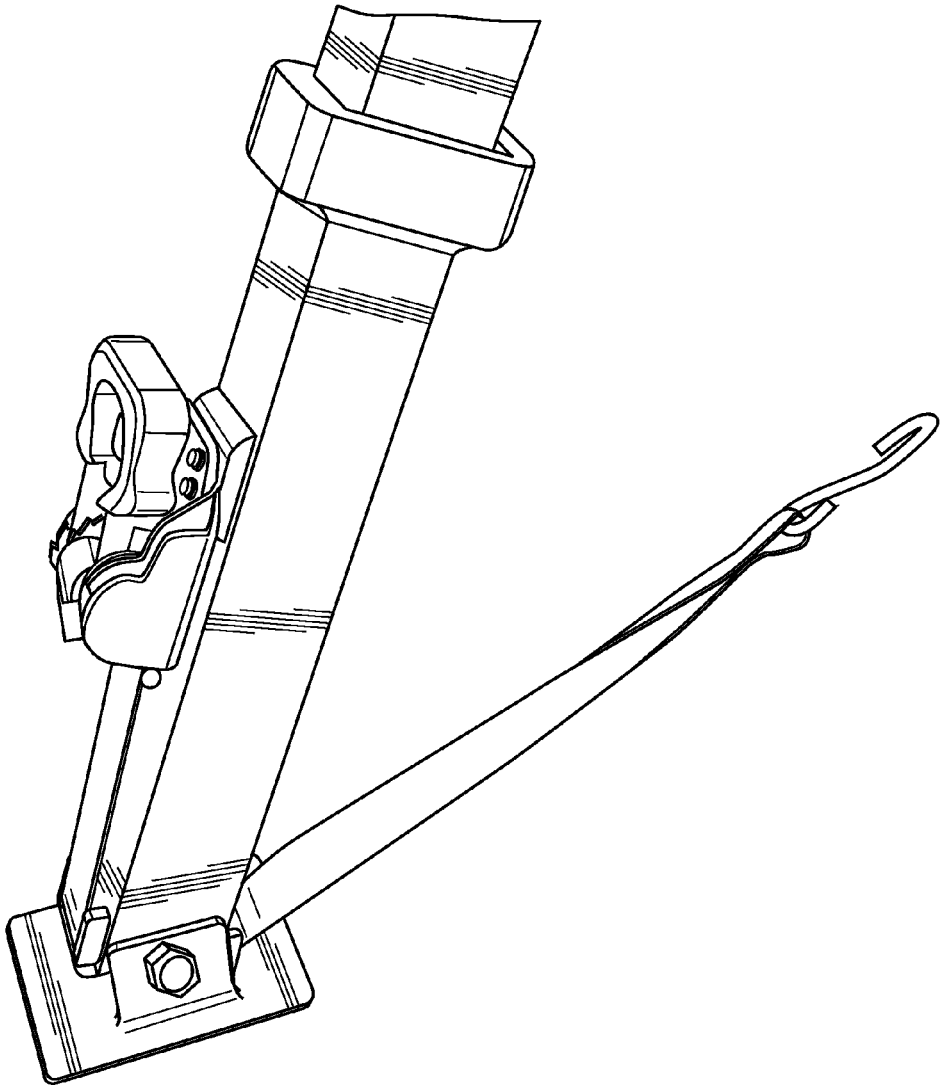
FIG. 21 shows a detail view of the ratchet strap affixed to a vehicle on its side, according to an embodiment of the invention.
Figure 22:
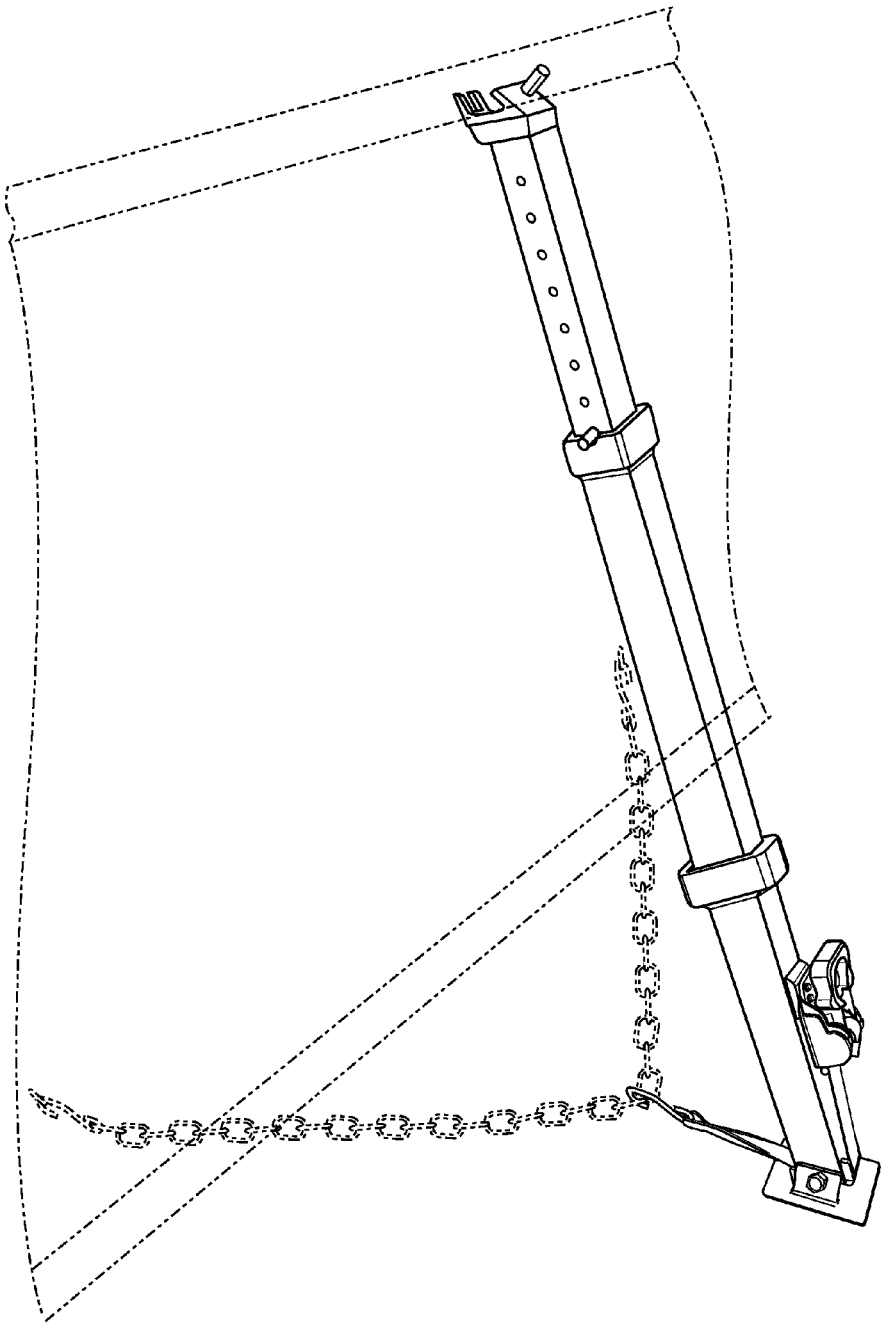
FIG. 22 shows a detail view of the ratchet strap affixed to a chain connected a vehicle on its side, according to an embodiment of the invention.
Figure 23:
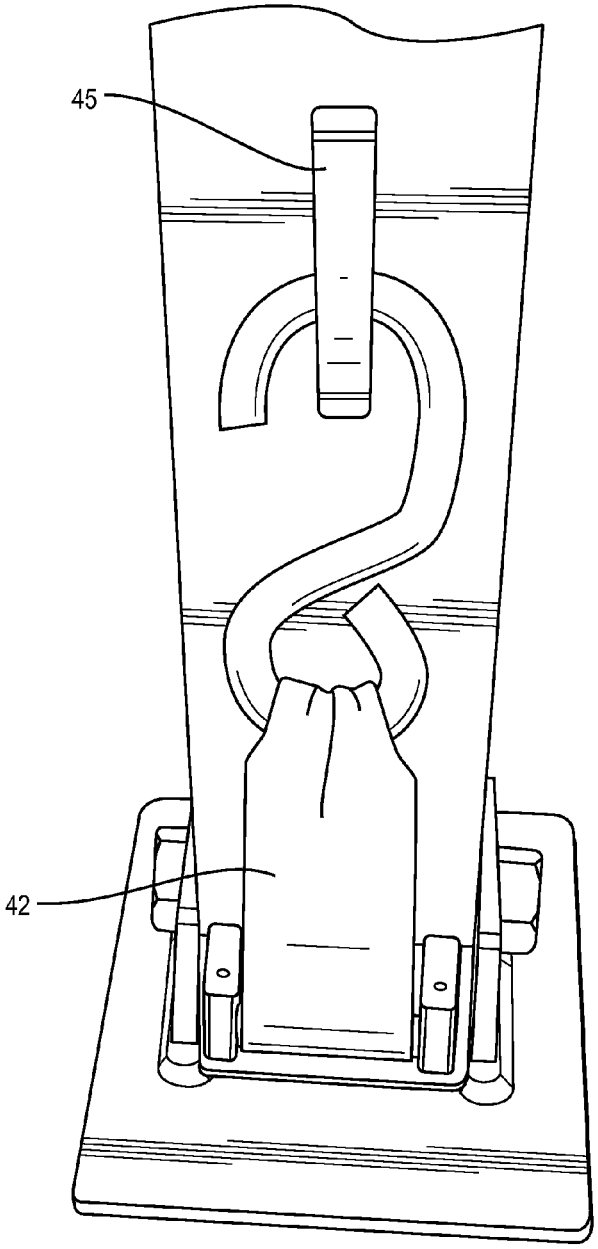
FIG. 23 shows a detail view of the ratchet strap hook end affixed to an on-board storage hook, according to an embodiment of the invention.

Referring now to FIG. 1 and FIGS. 19-23, the attached strap feature of the present invention preferably is of the ratchet strap type packaged within a self-contained recoiling mechanism 40, which provides for superior strap and strap slack management. FIG. 19 shows an embodiment of the stabilization strut according to the invention, with an attached ratchet strap 42, and FIG. 20 shows a detail view of the embodiment of FIG. 19. FIG. 21 shows a detail view of the ratchet strap affixed to a vehicle on its side, and FIG. 22 shows a detail view of the ratchet strap affixed to a chain connected to a vehicle on its side. FIG. 23 shows a detail view of the ratchet strap hook end affixed to an optional on-board storage hook 45, according to another embodiment of the invention. The recoiling strap assembly preferably is mounted to the backside of the lower outer strut tube, at a location between the base and upper end of the lower outer tube. If an add-on jack pocket is affixed to the strut tube, then the strap assembly will be between the base and the catch pocket. The strap is pre-threaded through a set of fairleads attached to the bottom of the lower outer strut tube, between the base plate and the tube bottom. Thus, the hook of the strap is in a ready-to-use position at the front of the base. Another unique feature is the loop attached to the front of the lower outer strut tube, where the strap hook may be removably secured for storage.

To allow the strap some travel, the ratchet handle is placed in the locked open position perpendicular to the lower outer strut tube. In this position, the strap may be extended, however, the strap will automatically recoil, when extension force is released. The strap may be hooked to an object or to additional flexible tie members, if the strap length is inadequate. If necessary, chain(s) or similar flexible tie members can be used to create multiple connection points with an object from the single strap hook point. To tighten the strap, move the ratchet handle into operating range between the locked open free-wheel position and the locked closed position, parallel to the strut. The strap is tightened as the handle is repeatedly moved between the two locking positions. Once the desired tension is achieved, the handle is moved to the locked closed position, parallel to the strut.

Figure 24:
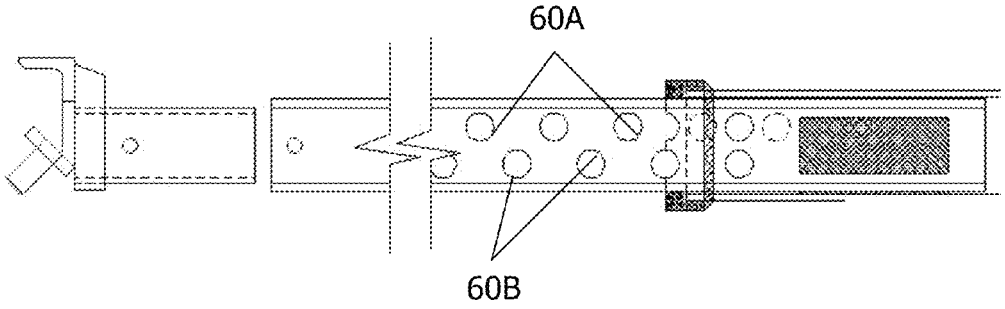
FIG. 24 shows an alternative embodiment according to the invention, having multiple staggered rows of saddle holes for fine adjustment of the strut length.

Referring now to FIG. 24, an alternative embodiment of the lifting strut system is shown. In this embodiment, the tubular strut member has two (2) lines of saddle holes 60A,B to receive the lift pin 18 or shoring pin 50. This concept allows for finer adjustment of the strut length, without concern of shear tearout of the pin from hole to hole. The jack lift bracket in this embodiment includes two saddle holes, similar to the two saddle holes on the stop collar below. The first embodiment will index every 2 inches as the holes are on 2" centers. These holes are also on 2" centers, however, there are 2 lines of them offset by 1". Therefore 1" indexing can be achieved. Optionally, additional sets of saddle holes can be located in other tube walls as well, to obtain an even finer adjustment ability.

The lifting strut members optionally include one or more sections of round or square tubing combined with one or more sections of another round or square tube. The add-on jack technology disclosed herein is compatible with round tube shores, with some slight shape changes in the bottom lip of the jack that engages the strut pocket, and the top saddle bracket that engages the lift pin(s). For fashioning a round tube shore, the catch pocket on the outer shore tube would be a circular pocket all the way around. The jack catch lip would be arched to fit. The top jack saddle bracket would not differ much from the current design, however, the stop collar on the top of the outer tube would be round with saddle holes around the circumference, that could be at various depths to allow for fine adjustment. The inner tube optionally is a round tube with multiple lines of holes staggered, which may involve twist alignment.

One point of potential concern is the indexing issue, when the holes are on 2" centers. This is typically not a problem, when using the apparatus as a stabilization shore with the strut set at an angle, as the angle is adjusted for proper fit/tightening. However, when the strut is set vertically, as in collapse shoring or similar, the problem becomes more apparent. This is where an adjustable jacking head may come into play with a minimum of 2" adjustment. Another solution to the indexing issue is the staggered off-center holes in the strut wall and possibly additional holes in the opposite walls to allow for finer adjustment.

Another situation that poses a potential problem is that, when you put the add-on jack on and you crank it all the way out, you may not end up on a hole to pin. In addition, it may be undesirable to let the jack down to the nearest hole, as this could have adverse affects on the rescue. There are a few solutions to this problem, including: 1) adjust jack travel such that it travels ¼" over 12" (i.e., up to 12¼"), that way you always have a hole when you get to full extension; 2) put a second jack on the back side of the strut, while the first jack is still on the front, so that you can raise more from the backside until lift is achieved or until you reach the next hole for pinning. This is a good reason for using two (2) lift pins and no shoring pins. The first lift pin can't be used, as it is loaded by the first jack, so slip the second lift pin in down as close to the outer tube as the available holes will allow, and put the second jack in place and crank it up slightly to engage the pin. In some situations, one could even put a third or fourth jack on (i.e., one on each side of the strut).

However, putting a second jack on the back side of the strut may be difficult, due to proximity to the object being supported, so an alternate embodiment of the strut would have a jack pocket, saddle pin holes, and indexing holes on all four (4) sides of the strut—a second (or primary) jack could also be placed on the side of the strut. This requires a little more clearance between the jack and strut, but in this configuration one can have a pair of staggered holes on each side of the jack and achieve finer indexing as well.

According to its contemplated use, to use the adjustable telescopic strut with the shoring pin, place the strut base on the ground surface with the upper end leaning toward the object to be supported, away from the operator side or the side with the affixed ratchet strap assembly. Remove the shoring pin to allow for extension of the inner tube, and extend the inner tube to its desired position. Replace the shoring pin in the conventional hole in the outer tube, release the lock on the retractable ratchet strap assembly and place it in the free-wheel position. Attach the end of the strap to an object such that the object, strut and strap form a triangle. Tighten the strap with the ratchet mechanism. To lift the object, insert the lift pin through the saddle holes in top of the outer tube; place the jack bottom lip into the catch pocket affixed to the outer strut tube; push the jack top in, such that the saddle holes on top of the jack lift bracket align below the lift pin. Raise the jack slightly to relieve pressure on the shoring pin. Remove the shoring pin and lift the extendible tubing member to the desired point. If full jack extension is achieved, yet additional lift is desired, insert the shoring pin or a second lift pin, reset the jack or get second jack, and repeat process. Full strut extension is achieved, when internal stop collars meet. Note that the shoring pin is not necessary; shoring and lifting can be accomplished through use of lift pin only, if so desired.

In lieu of stop collars, an improved means for preventing over-extension of a telescopic stabilization strut includes a connecting rod or similar rigid member, or a cable or similar flexible connection attached to or near the base and run up through the inside of the outer and inner tube or tubes. The top of this rod includes a J-shaped hook or other catch means for stopping extension of the inner tube or tube. The hook or catch means engages a cross member fixed to the lower end of the inside tube, or other means for catching the connecting member to prevent over extension.

In a strut comprising square perforated tubing, one problem is that a rigid connecting rod running up through the center could interfere with pinning successive sections to secure the telescopic tubular members. One means to circumvent this problem includes adding a rigid connecting member which positions the rod in the corner of the inside tube or tubes. A flexible connecting member, however, will readily move aside, when pinning through the perforations to secure the telescopic tubular members.

An alternative embodiment includes an inner tube or tubes containing an open slot along the entire length, with the exception of a length near the end determined by the overlap requirement. The outer tube includes a pin or similar component, which slides freely along the inner tube slot. Once minimum overlap is achieved, the pin contacts the end of the slot, preventing further extension. The pin optionally is rigidly fixed, spring loaded, removable, or otherwise attached and activated. Likewise, the slot optionally is located within the outer tube or tubes and the stop pin on the inner tube or tubes. Another option is a square outer tube with a round stop collar affixed to the top to allow for a round inner tube.

EXAMPLES

X-Strut Features

One useful feature of the adjustable lifting strut system is that it allows for the jack and strut to be transported separately from the struts, thereby reducing weight, when lifting ability is not needed. The fact that the jack is reversibly removable from the strut also allows for more lift height than do prior art struts having a built-in jack. After using the full stroke (normally 12") of the jack to extend the strut (thereby lifting an object), the jack can be removed from the strut, reset and reattached in a different position along the length of the strut, where the jack can then be used to continue lifting. Depending on the length of the struts and each successive lifting cycle, resetting the jack may be repeated multiple times. Additionally, a single jack can be used, reset, and reattached to several separate struts as needed, thereby reducing the total number of jacks needed and reducing the weight required to lift with multiple struts at the same accident or disaster scene. This also can save costs for rescue squads, when purchasing equipment.

Cone Pin/Lift-Arm Interaction

Figure 25:
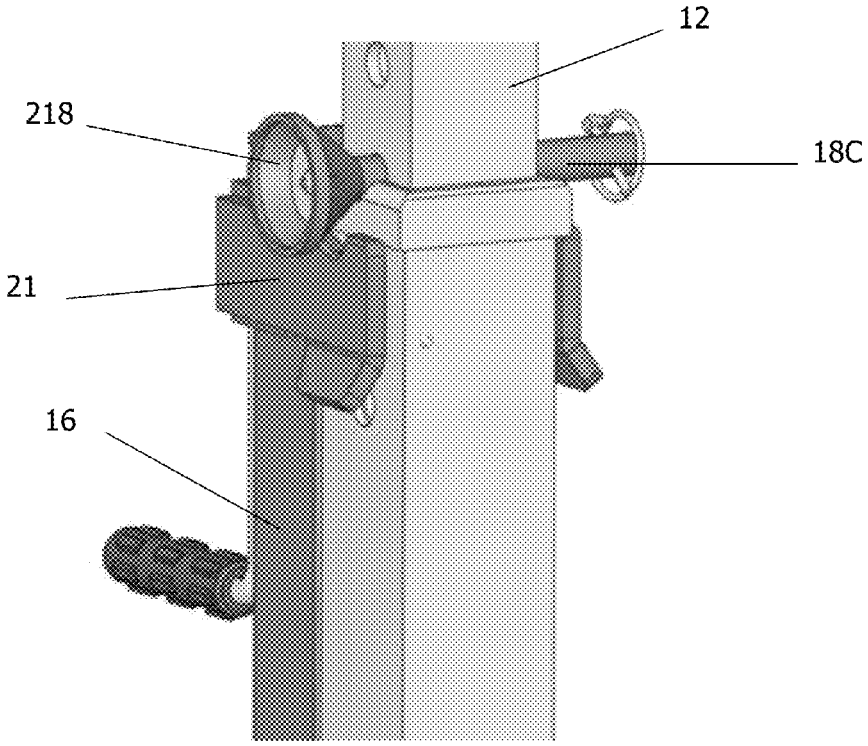
FIGS. 25-27B show an alternative embodiment according to the invention, including a cone pin providing improved engagement with the jack lift arm.
Figure 26:
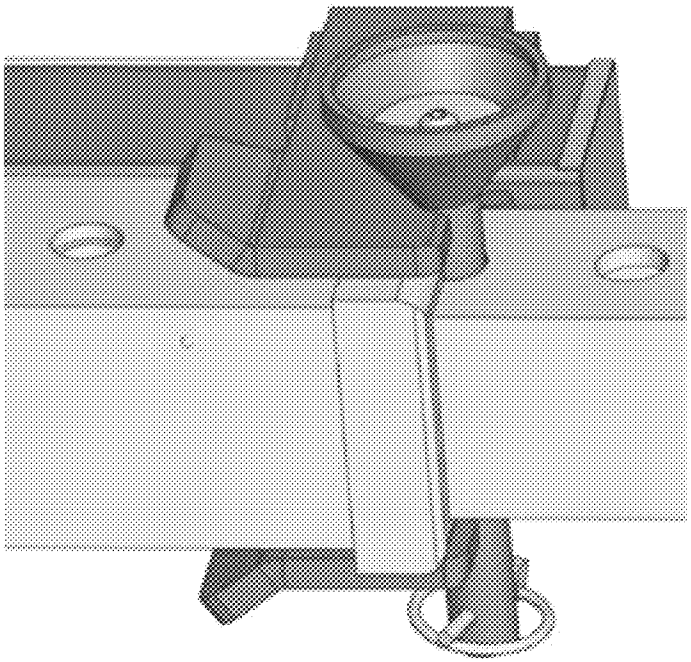
Figure 27A:
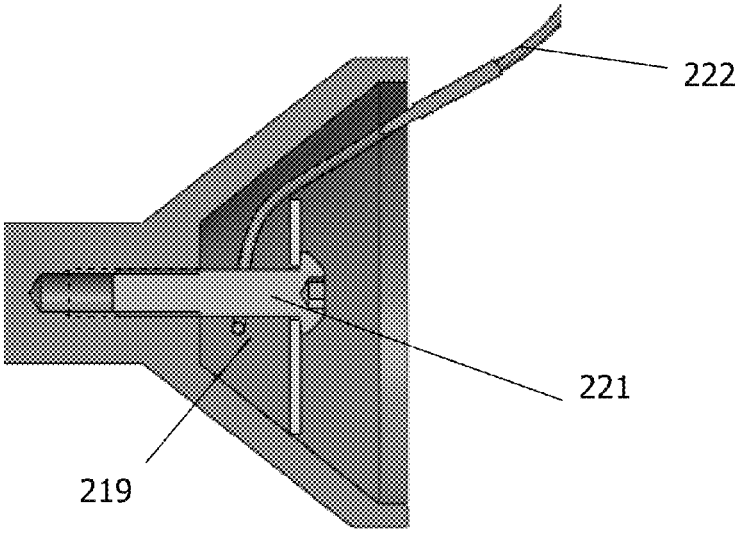
Figure 27B:
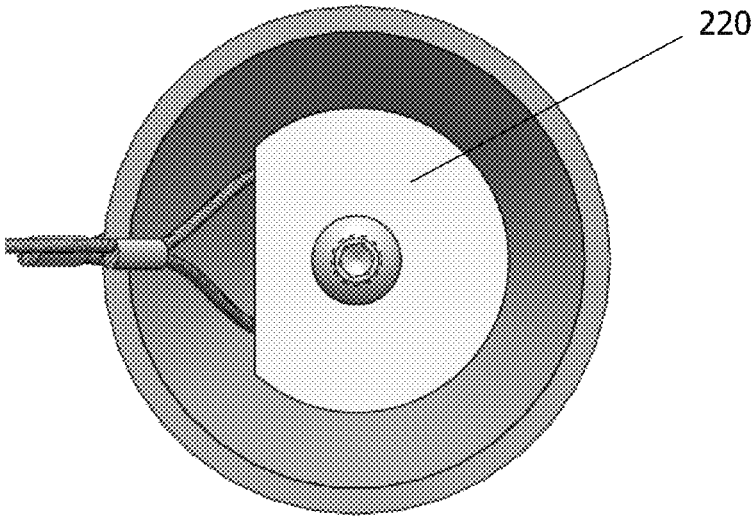

Referring now to FIG. 25, an improved cone pin 18C is shown, which makes lifting upper strut 12 with jack 16 simpler and avoids some of the limitations of other lift pins. The cone pin 18C has a cone-shaped head or handle 218 that automatically aligns the pin to the jack correctly. As the jack 16 is extended, the lift arm 21 attached to the jack rises to meet the pin (FIG. 25). Without this mechanism (e.g., 18), if the pin is not inserted the correct amount, then the jack lift arm may not catch the pin correctly. As shown in FIG. 26, the lateral force applied by the jack on the cone-shaped end of the pin forces the pin to slide out of the strut and be seated into the correct position. In the preferred embodiment, the cone pin 18C is designed to protect the attachment of the pin to a lanyard from damage that could lead to it breaking apart from the pin (FIGS. 27A,B). The lanyard connection point is protected by a hollow area 219 in the back of the cone by an affixed washer 220, which preferably has a clipped side. A machine screw 221 captures the lanyard 222 without pinching it or otherwise applying a force to the lanyard wire that could cause damage.

Lift Arm Pin Ramp

Figure 28A:
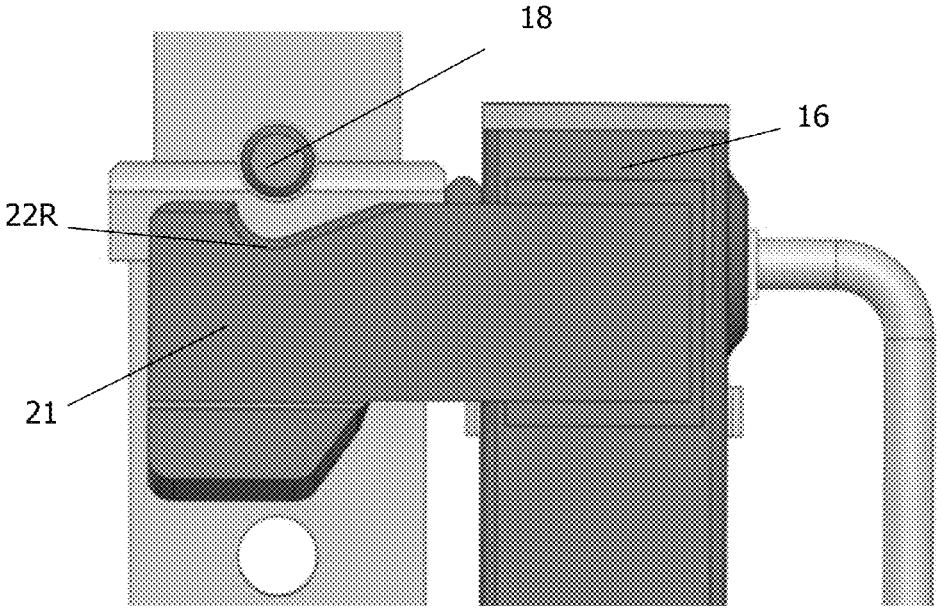
FIGS. 28A-29B show an alternative embodiment according to the invention, including a ramped pin slot providing improved engagement with the strut lift pin.
Figure 28B:
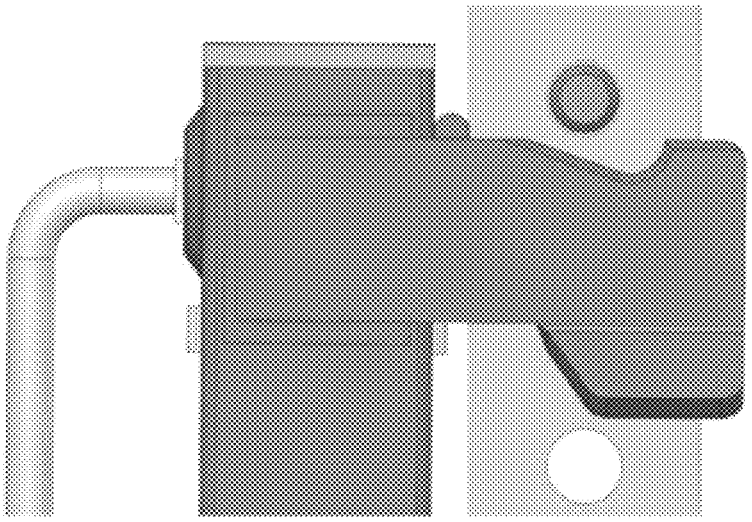
Figure 29A:
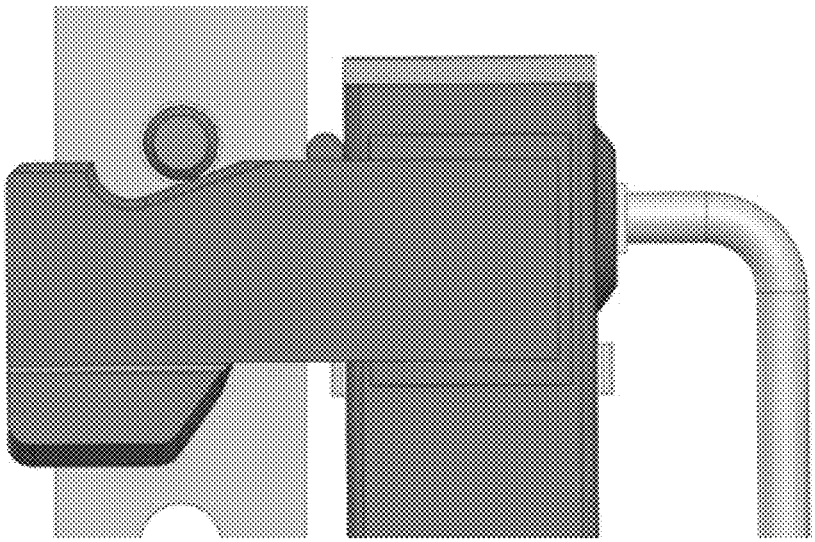
Figure 29B:
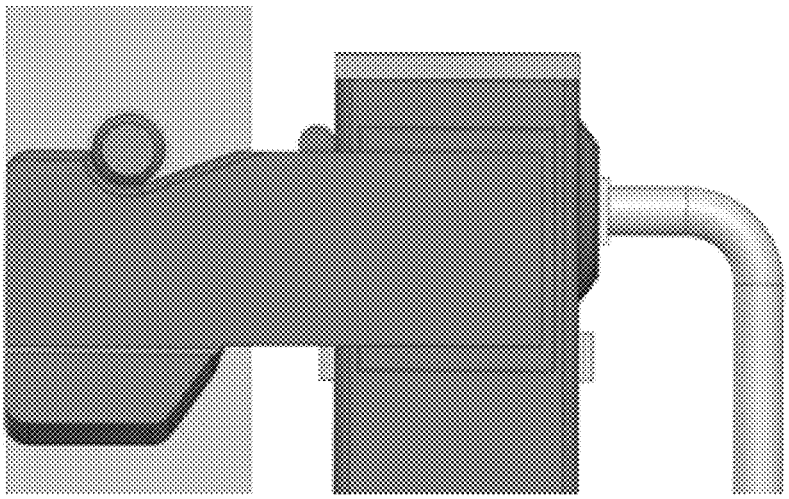

Referring now to FIGS. 28A,B, another feature that optionally is added to the lifting jack 16 is an improved pin-jack interface on the jack lift bracket 20 or lift arm 21. An improved feature of lift arm 21 includes a ramped slot (pin ramp 22R) that engages the lift pin 18 or 18C. As shown in FIG. 28A, when jack 16 is in the collapsed position, it rests against the strut with the slot feature aligned with pin. However, because of the difference in the tubing size of the outer 10 and inner 12 tubes, when the jack is placed on the strut in an extended position (e.g., when a user is preparing to lower a load that has been previously lifted with the strut), the slot feature does not align with the pin (FIG. 28B). With the addition of pin ramp 22R to the slot on the lift arm, as the jack lift arm engages the load of the lift pin 18/18C, the pin ramp 22R guides the lift arm 21 into proper alignment with the pin (FIGS. 29A,B).

Flared Lift Arms

Figure 30A:
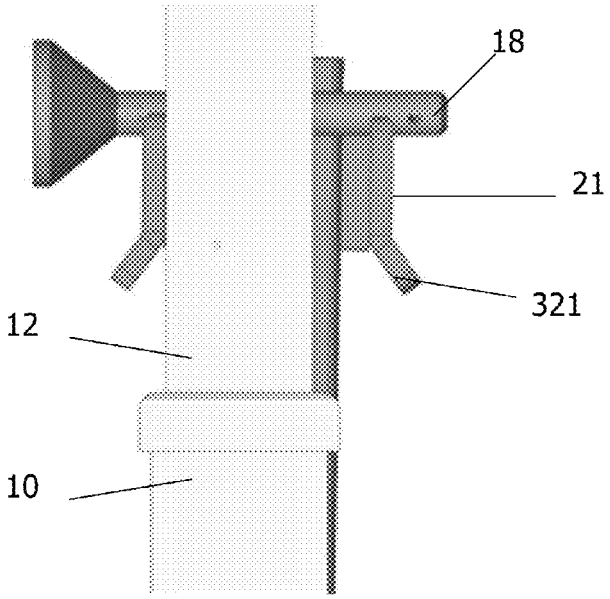
FIGS. 30A-30C show an alternative embodiment according to the invention, including a flared lift arm providing improved engagement with the strut.

Similarly, during the same process of lowering the strut under load and for the same fact that there is a difference in the tubing size between the inner and outer tubing sections, it is possible to engage the pin with the jack in misaligned position (FIG. 30A). This can result in the jack features getting caught on the collar of the outer tube 10 as the jack is collapsed.

Figure 30B:
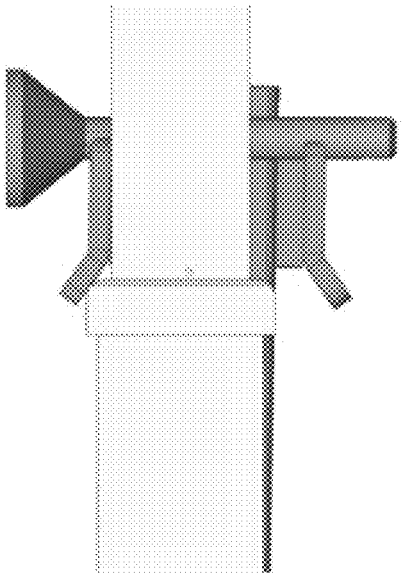
Figure 30C:
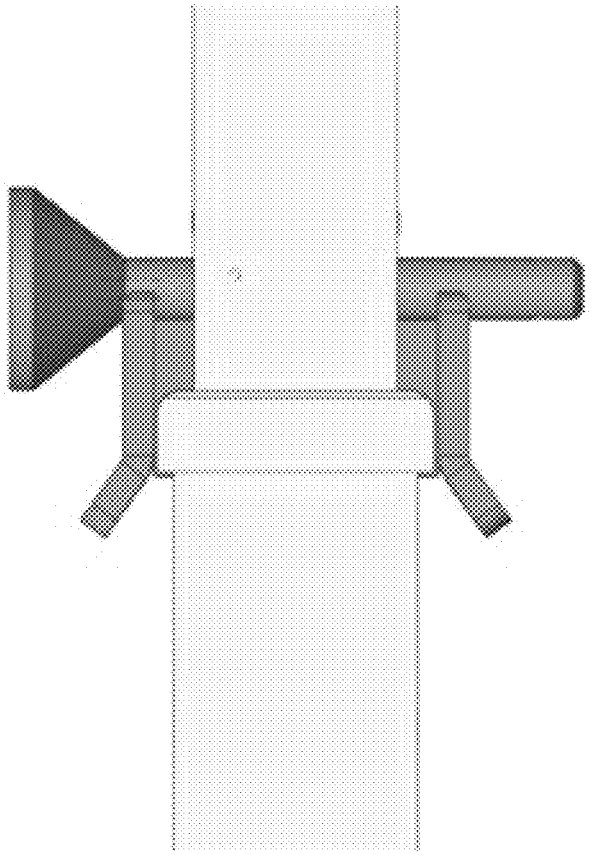

With the addition of a flare or wing 321 on the side of the jack lift arm 21 opposite the pin ramp 22R, the lift arm is guided into correct alignment with the outer tubing section of the strut, when the jack is collapsed. As the wing 321 contacts the collar of the outer tube 10, the force of the load being lowered pushes the lift arm 21 into correct alignment, so it will not catch on the lower tube (FIGS. 30B,C).

Strut Base Fairlead

Figure 31A:
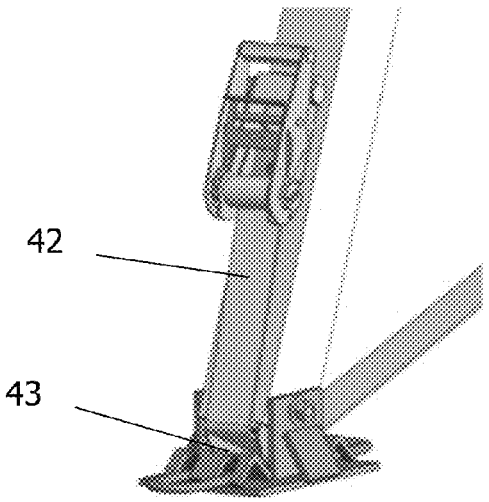
FIGS. 31A-31C show an alternative embodiment according to the invention, including an improved fairway lead design providing improved engagement with the ratchet strap.
Figure 31B:
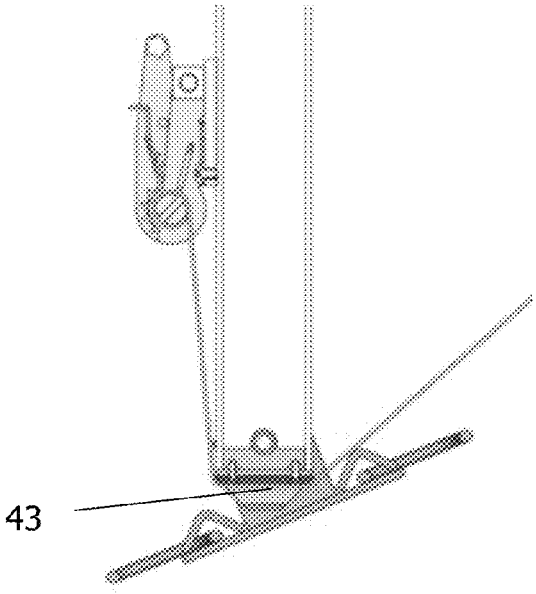
Figure 31C:
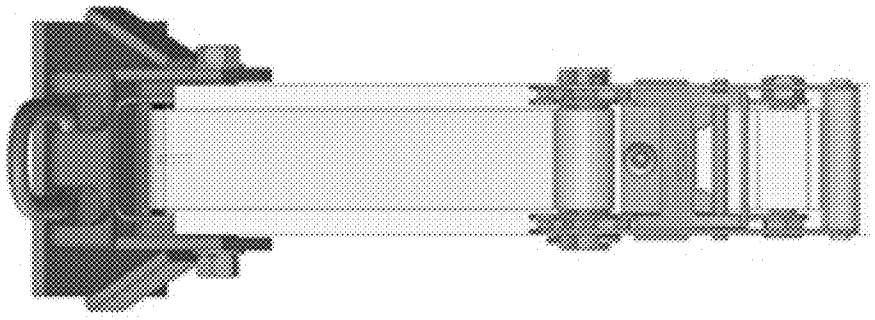

A preferred embodiment of the adjustable lifting strut system includes an on-board ratchet strap 42. This allows for quick deployment and securing the base of the strut. In order to access the ratchet mechanism, it needs to be on the side of the strut opposite from the vehicle or other object being stabilized. The strap therefore must pass across or under the strut to reach the object (FIG. 31). An improved fairlead mechanism captures the strap in a way that allows it to bear against a UHMW plastic or other sliding surface. The radius on the sliding surface 43 prevents detrimental stress that can occur to the straps 42 when they are kinked at a sharp corner (FIGS. 31B,C).

Invertible Jack with Interchangeable Plug-in Lift Arms

Figure 32A:
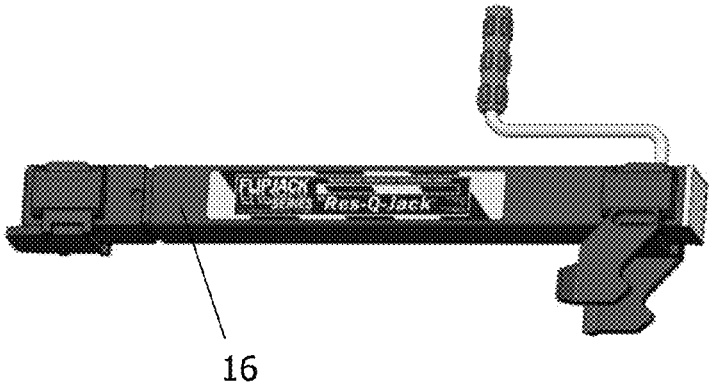
FIGS. 32A-33B show an alternative embodiment according to the invention, including an invertible jack providing improved engagement with the strut and additional utility.
Figure 32B:
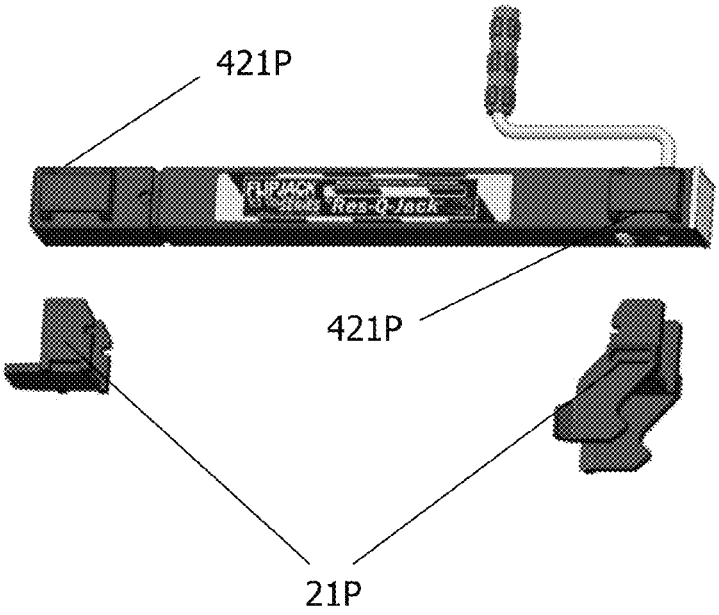
Figure 33A:
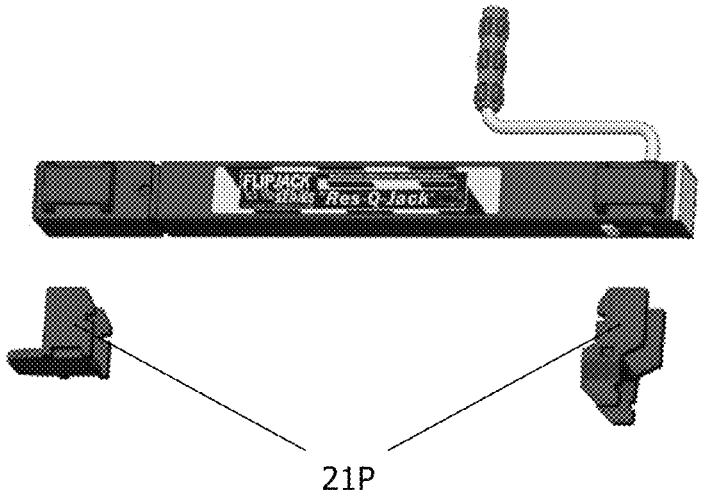
Figure 33B:
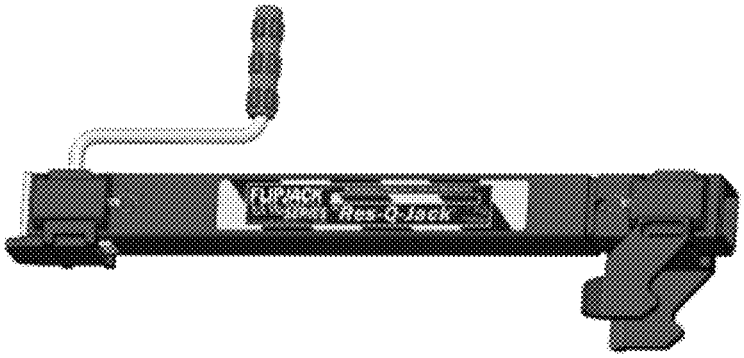
Figure 34:
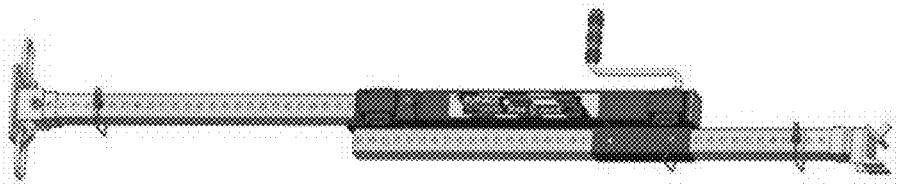
FIG. 34 shows an alternative embodiment according to the invention, optionally configured to serve as a stand-alone strut with a built-in jack.
Figure 35:
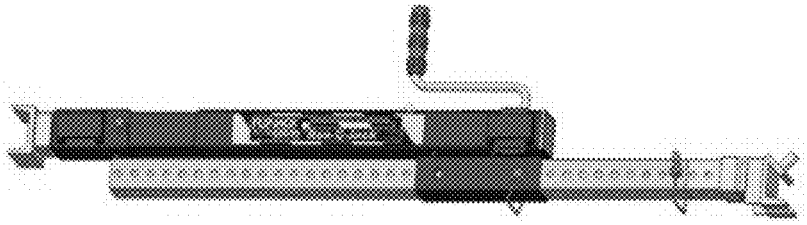
FIG. 35 shows an alternative embodiment according to the invention, optionally configured to receive end fittings directly into the end of the jack in a ram configuration.
Figure 36:
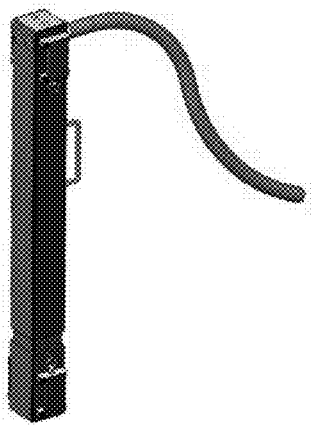
FIG. 36 shows an alternative embodiment according to the invention, including a hydraulic jack.

In an alternative embodiment of the adjustable lifting strut system, jack 16P includes reversibly removable plug-in lift arms 21P, which optionally are strut-specific and plug-in to a universal port 421P on the jack (FIGS. 32A,B). This feature provides many advantages to the system, one being that the plug-in lift arms can be switched out to make the jack compatible with different struts. This allows a user to purchase different struts, but not be required to purchase separate jacks to match. Thus, the jack can be used with any strut, as long as the correct plug-ins matching that particular strut are available (FIGS. 32A,B-33A,B). Further, the improved jack 16P preferably has a symmetrical design, such that the plug-ins can be switched to allow the jack to be inverted (flipped) on the strut. This can be advantageous, such as, for example, when something in the accident or disaster scene is interfering with the cranking of the handle. The jack also optionally is configured to serve as a stand-alone strut with a built-in jack (FIG. 34), as well as optionally being configured to receive end fittings directly into the end of the jack in a ram configuration (FIG. 35). The jack optionally is hydraulic (FIG. 36) or mechanical.

Lift Arm Plug-ins

Figure 37A:
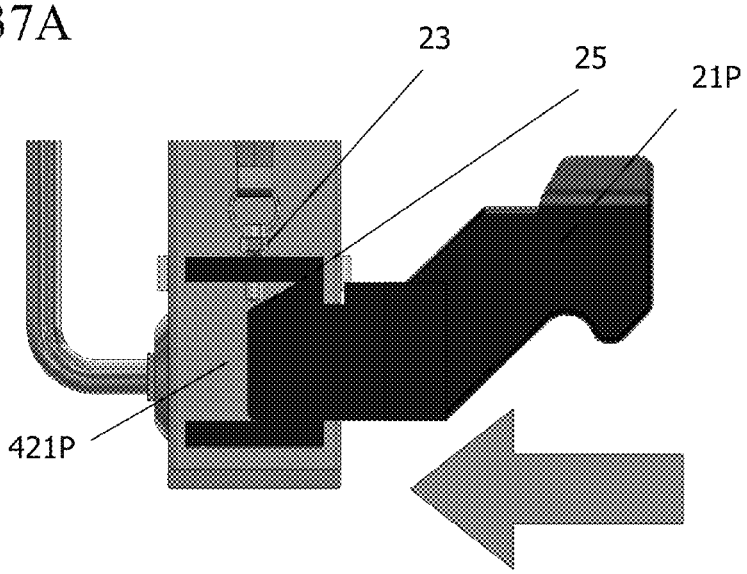
FIGS. 37A-40C show an alternative embodiment according to the invention, including a variety of mechanisms for securing the removable lift arms to the jack.
Figure 37B:
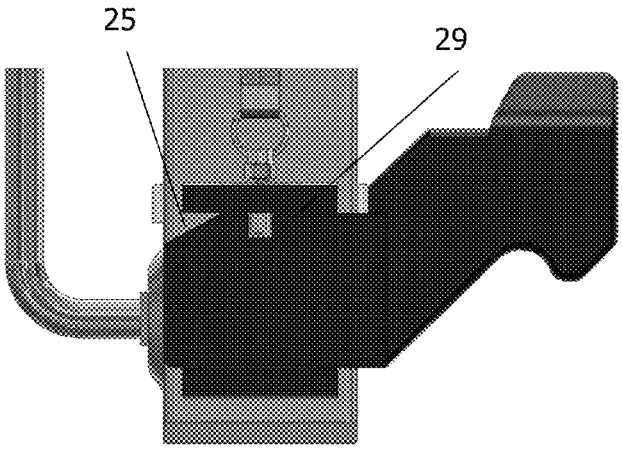
Figure 38:
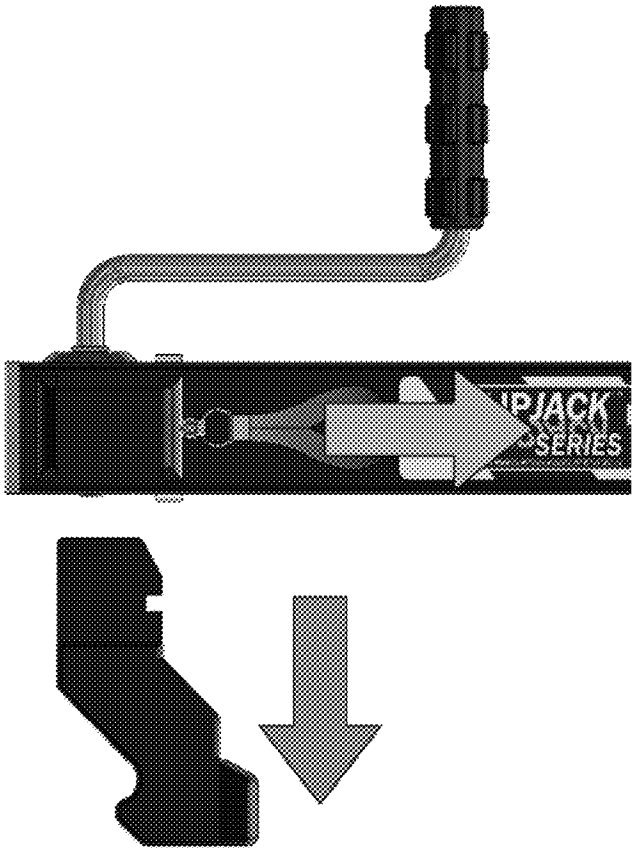
Figure 39A:
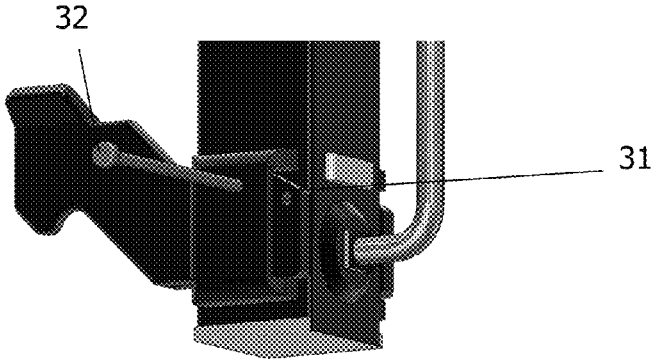
Figure 39B:
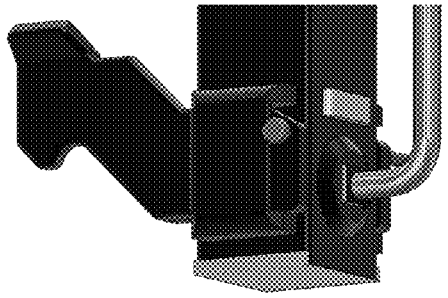
Figure 39C:
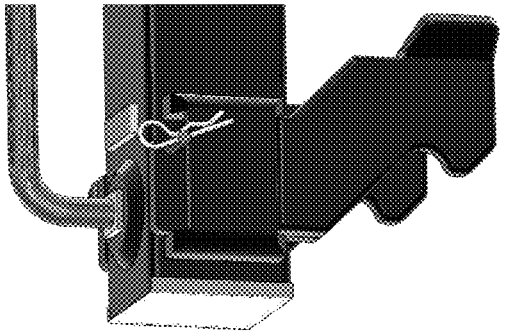
Figure 40A:
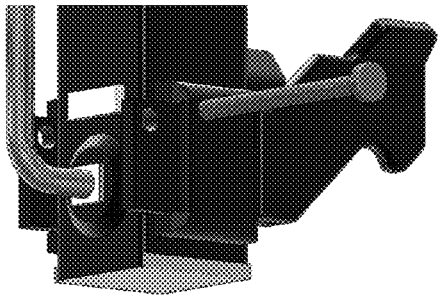
Figure 40B:
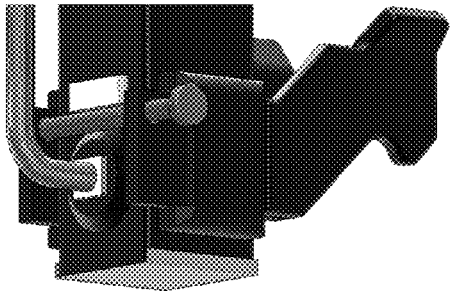
Figure 40C:
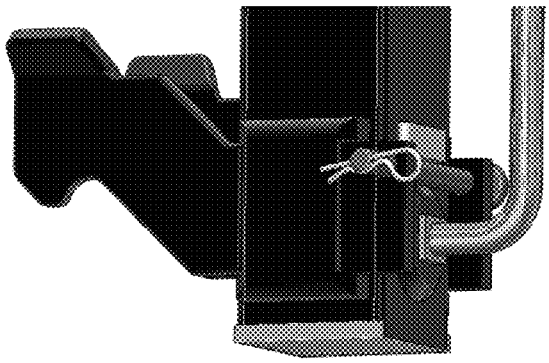

A variety of means are used for securing the lift arm plug-in fittings to the jack. One example is a spring-loaded plunger 23. Referring now to FIGS. 37A-B, the plug-in 21P is inserted into port 421P, and the plunger 23 is pushed out of the way by a ramped lead-in 25 (FIG. 37A). The plunger then, by the force of it's internal spring, falls into a groove 29 in the plug-in (FIG. 37B). The spring pin is located on a single side, or alternatively there may be two spring pins, one on each side of the jack body. To remove the plug-in, the handle is pulled, thereby removing the plunger from the groove and allowing the plug-in to slide out freely (FIG. 38). Another means for securing the plug-ins is to lengthen the plug-ins, so they extend beyond the width of the jack, making space for guide holes 31 through which to pass a securing pin 32 (FIG. 39A). The pin passes through the holes, behind the jack, thereby preventing the plug-ins from sliding out (FIG. 39B). A clevis or similar retaining means passes through the end of the retaining pin to keep the pin from sliding out (FIG. 39C). An alternative means for securing the plug-ins include a pair of clevis pins, one for each plug-in. The clevis pin 31 is inserted through a cross-hole 32 through the plug-in and through the body of the jack (FIG. 40).

Threaded Strut

Figure 41:
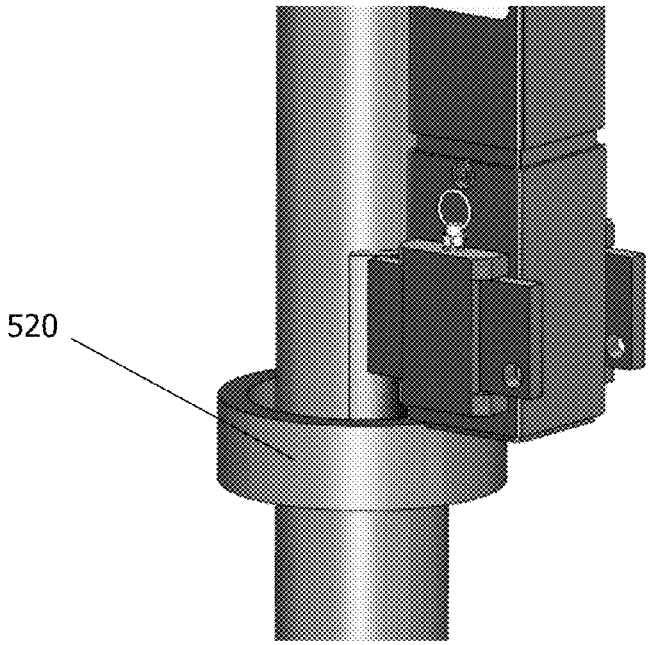
FIGS. 41-44 show an alternative embodiment according to the invention, optionally configured for use with round struts.
Figure 42:
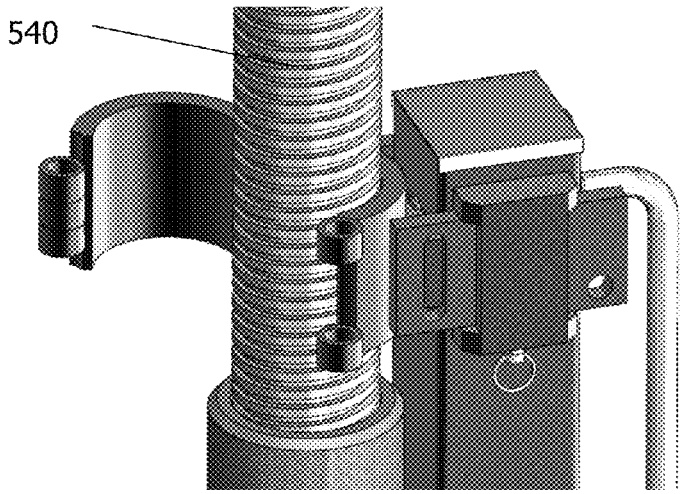
Figure 43:
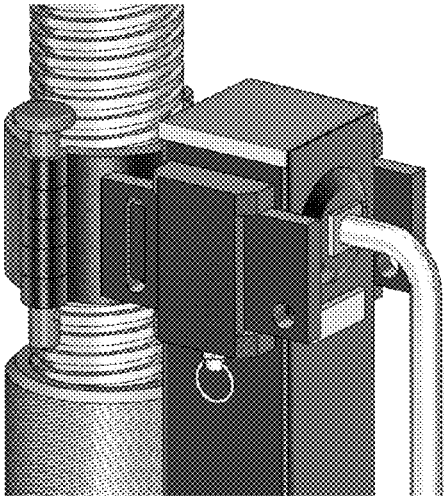
Figure 44:
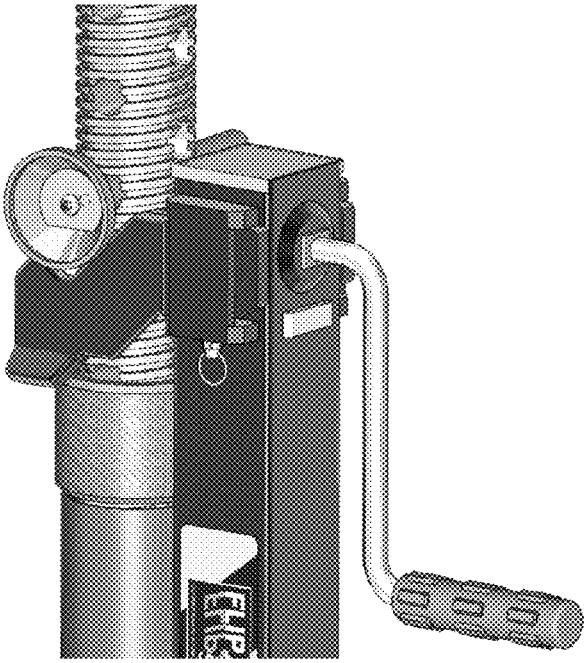

Referring now to FIGS. 41-44, an alternative embodiment of the adjustable lifting strut system is shown, which comprises a strut that freely telescopes and has a threaded collar, which sets the length of the strut, and a concentric lift shelf 520 (FIG. 41). This arrangement provides more freedom and versatility than prior art struts, because the jack can be rotated around the strut into any position to avoid potentially interfering objects. To engage the jack with the inner section of the strut, one embodiment includes a hinged inside threaded collar 540 (FIG. 42). The threads on this collar mate with the threads on the inner section of tubing, and close around the back side of the strut. A clevis pin passes through to secure the connection (FIG. 43). Another option for jack engagement with the inner section is a pin, such as lift pin 18 or cone pin 18C. The concentric lift shelf provides the flexibility to position the holes at 90 degrees and 1" spacing, maximizing strength. The jack engages the pin in the same manner as described above for the other embodiments (FIG. 44). The inner section of this strut optionally is made from a tubing rather than a solid bar. Also, an optional air fitting at the bottom of the strut's outer tube allows for a compressed air source to be attached. An O-ring on the inner section seals it inside the outer section, and the air pressure extends the strut to tighten it in a trench wall shoring or other scenario.

It is to be understood that the architectural and operational embodiments described herein are exemplary of a plurality of possible arrangements to provide the same (or equivalent) general features, characteristics, and general system operation. Therefore, while there have been described the currently preferred embodiments of the present invention, those skilled in the art will recognize that other and further modifications may be made, without departing from the spirit of the present invention, and it is intended to claim all modifications and variations as fall within the scope of the appended claims. Accordingly, it must further be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A telescopic strut system, comprising:

a lower outer tubular member in slidable engagement with an upper extendable inner tubular member, wherein said tubular members are square or round; and means for receiving and supporting a reversibly-removable jack affixed to an outer surface of said outer tubular member, said means comprising a concentric or annular lift shelf;

said jack including means at an upper end thereof for engaging a strut lift pin or other engagement means for extending said upper inner tubular member.

2. The telescopic strut system of claim 1, wherein said strut lift pin comprises means for locating said strut lift pin automatically for correct engagement of said jack with said strut lift pin.

3. The telescopic strut system of claim 2, wherein said means for locating said strut lift pin comprises a cone-shaped head or handle thereon.

4. The telescopic strut system of claim 3, wherein said cone-shaped head or handle protects attachment of said strut lift pin to a lanyard.

5. The telescopic strut system of claim 1, wherein said means at an upper end of said reversibly-removable jack, for engaging said strut lift pin or other engagement means, comprises at least one lift arm that includes a ramped slot for engaging said strut lift pin or other engagement means.

6. The telescopic strut system of claim 1, wherein said means at an upper end of said reversibly-removable jack, for engaging said strut lift pin or other engagement means, comprises:

a pair of lift arms including a flare or wing on an edge of said lift arm opposite an edge that engages said strut lift pin or other engagement means, such that said lift arm is guided by said flair or wing into correct alignment with said outer tubing member when said jack is collapsed.

7. The telescopic strut system of claim 1, further comprising a fairlead at said lower end of said lower outer tubular member, said fairlead passing under a bolt of a base member and over a plastic or other sliding surface for reducing wear on said fairlead.

8. The telescopic strut system of claim 1, wherein said means at an upper end of said reversibly-removable jack, for engaging said strut lift pin or other engagement means, comprises a pair of reversibly-removable plug-in lift arms.

9. The telescopic strut system of claim 8, wherein said reversibly-removable plug-in lift arms are strut-specific and plug-in to a universal port on said jack.

10. The telescopic strut system of claim 8, wherein said reversibly-removable plug-in lift arms are secured by a securing pin, clevis pin or spring-loaded plunger.

11. The telescopic strut system of claim 8, wherein said reversibly-removable jack comprises a symmetrical design, such that said reversibly-removable plug-in lift arms can be switched from one end of said jack to another, allowing the jack to be inverted on said strut.

12. The telescopic strut system of claim 8, wherein said strut lift pin comprises means for locating said strut lift pin automatically for correct engagement of said jack with said strut lift pin.

13. The telescopic strut system of claim 12, wherein said means for locating said strut lift pin comprises a cone-shaped head or handle thereon.

14. The telescopic strut system of claim 13, wherein said cone-shaped head or handle protects attachment of said strut lift pin to a lanyard.

15. The telescopic strut system of claim 8, wherein said means at an upper end of said reversibly-removable jack, for engaging said strut lift pin or other engagement means, comprises at least one lift arm that includes a ramped slot for engaging said lift pin or other engagement means.

16. The telescopic strut system of claim 8, wherein said means at an upper end of said reversibly-removable jack, for engaging said strut lift pin or other engagement means, comprises:

a pair of lift arms including a flare or wing on an edge of said lift arm opposite an edge that engages said strut lift pin or other engagement means, such that said lift arm is guided by said flair or wing into correct alignment with said outer tubing member when said jack is collapsed.

17. The telescopic strut system of claim 8, further comprising a fairlead at said lower end of said lower outer tubular member, said fairlead passing under a bolt of a base member and over a plastic or other sliding surface for reducing wear on said fairlead.

18. The telescopic strut system of claim 1, wherein said tubular members are round.

19. The telescopic strut system of claim 18, wherein said means for engaging and extending said upper inner tubular member comprises a threaded member and hinged collar for fine adjustment of alignment with engaging means.

20. The telescopic strut system of claim 18, wherein said upper tubular member comprises an adjustable threaded member for fine adjustment of strut length.

21. The telescopic strut system of claim 18, wherein said strut lift pin comprises means for locating said strut lift pin automatically for correct engagement of said jack with said strut lift pin.

22. The telescopic strut system of claim 21, wherein said means for locating said strut lift pin comprises a cone-shaped head or handle thereon.

23. The telescopic strut system of claim 22, wherein said cone-shaped head or handle protects attachment of said strut lift pin to a lanyard.

24. The telescopic strut system of claim 18, wherein said means at an upper end of said reversibly-removable jack, for engaging said strut lift pin or other engagement means, comprises at least one lift arm that includes a ramped slot for engaging said strut lift pin or other engagement means.

25. The telescopic strut system of claim 18, wherein said means at an upper end of said reversibly-removable jack, for engaging said strut lift pin or other engagement means, comprises:

a pair of lift arms including a flare or wing on an edge of said lift arm opposite an edge that engages said strut lift pin or other engagement means, such that said lift arm is guided by said flair or wing into correct alignment with said outer tubing member when said jack is collapsed.

26. The telescopic strut system of claim 18, further comprising a fairlead at said lower end of said lower outer tubular member, said fairlead passing under a bolt of a base member and over a plastic or other sliding surface for reducing wear on said fairlead.

27. The telescopic strut system of claim 18, wherein said means at an upper end of said reversibly-removable jack, for engaging said strut lift pin or other engagement means, comprises a pair of reversibly-removable plug-in lift arms.

28. The telescopic strut system of claim 27, wherein said reversibly-removable plug-in lift arms are strut-specific and plug-in to a universal port on said jack.

29. The telescopic strut system of claim 27, wherein said reversibly-removable plug-in lift arms are secured by a securing pin, clevis pin or spring-loaded plunger.

30. The telescopic strut system of claim 27, wherein said reversibly-removable jack comprises a symmetrical design, such that said reversibly-removable plug-in lift arms can be switched from one end of said jack to another, allowing the jack to be inverted on said strut.

31. The telescopic strut system of claim 27, wherein said strut lift pin comprises means for locating said strut lift pin automatically for correct engagement of said jack with said strut lift pin.

32. The telescopic strut system of claim 31, wherein said means for locating said strut lift pin comprises a cone-shaped head or handle thereon.

33. The telescopic strut system of claim 32, wherein said cone-shaped head or handle protects attachment of said strut lift pin to a lanyard.

34. The telescopic strut system of claim 27, wherein said means at an upper end of said reversibly-removable jack, for engaging said strut lift pin or other engagement means, comprises at least one lift arm that includes a ramped slot for engaging said lift pin or other engagement means.

35. The telescopic strut system of claim 27, wherein said means at an upper end of said reversibly-removable jack, for engaging said strut lift pin or other engagement means, comprises:

a pair of lift arms including a flare or wing on an edge of said lift arm opposite an edge that engages said strut lift pin or other engagement means, such that said lift arm is guided by said flair or wing into correct alignment with said outer tubing member when said jack is collapsed.

36. The telescopic strut system of claim 27, further comprising a fairlead at said lower end of said lower outer tubular member, said fairlead passing under a bolt of a base member and over a plastic or other sliding surface for reducing wear on said fairlead.

37. A jack suitable for use with a telescopic strut system of the type having a lower outer tubular member in slidable engagement with an upper extendable inner tubular member, wherein said tubular members are square or round, said jack comprising:

means at a lower end thereof for receiving and being supported by said lower outer tubular member;

means at an upper end thereof for engaging a strut lift pin or other engagement means for extending said upper inner tubular member;

wherein said jack comprises a symmetrical design, such that said jack can be inverted on said strut.

38. The jack of claim 37, wherein said jack is mechanical, hydraulic, pneumatic or electric and is configured to receive end fittings directly into the ends of the jack in a ram configuration.

39. The jack of claim 37, wherein said jack is configured as a stand-alone strut with a built-in jack.

40. The jack of claim 37, wherein said jack is configured as a stand-alone jack, without struts.

* * * * *